US007322542B2

(12) United States Patent
Reinke

(10) Patent No.: US 7,322,542 B2
(45) Date of Patent: Jan. 29, 2008

(54) AUTOMATIC WEB WINDING SYSTEM

(75) Inventor: Stephen M. Reinke, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 194 days.

(21) Appl. No.: 11/130,441

(22) Filed: May 13, 2005

(65) Prior Publication Data

US 2006/0255202 A1 Nov. 16, 2006

(51) Int. Cl.
*B65H 67/04* (2006.01)
*B65H 19/30* (2006.01)

(52) U.S. Cl. ..... 242/533.7

(58) Field of Classification Search ..... 242/523.1, 242/527, 527.2, 532.3, 533, 533.1, 533.7, 242/580, 580.1, 526.3
See application file for complete search history.

(56) References Cited

U.S. PATENT DOCUMENTS 3,712,553 A * 1/1973 Napor et al. ..... 242/418.1
3,962,019 A * 6/1976 Rejeski ..... 156/428
4,029,538 A 6/1977 Vance, Jr. ..... 156/502
5,256,232 A * 10/1993 Fuss et al. ..... 156/187
5,679,207 A 10/1997 Palone et al. ..... 156/507
5,871,169 A * 2/1999 Hasegawa ..... 242/526.3
6,129,303 A * 10/2000 Karaki et al. ..... 242/523.1
6,412,729 B2 7/2002 Kury et al. ..... 242/533.4

* cited by examiner

*Primary Examiner*—Peter M. Cuomo
*Assistant Examiner*—William E Dondero
(74) *Attorney, Agent, or Firm*—Stephen H. Shaw

(57) ABSTRACT

An automatic web winding system for creating a registered perforated web stock roll, from a perforated web, that includes a web leader, a web trailer, and a die assembly that creates the web leader of a first web stock roll and the web trailer of a second web stock roll. A winding assembly automatically wraps and cinches the web trailer to an associated core prior to forming the second web stock roll; and a core loader assembly automatically loads a core onto the winding assembly and transfers the web trailer to winding assembly.

16 Claims, 27 Drawing Sheets

AUTOMATIC WEB WINDING SYSTEM

FIELD OF THE INVENTION

The invention relates generally to the field of web winding and creating stock rolls of web, and in particular to preparing both web ends of a stock roll of web for subsequent splicing operations. More specifically, the invention relates to preparing both web ends of a perforated web, such as photographic film, for on-pitch ultrasonic splicing, and creating a web leader on a web stock roll that enables automatically handling of the web at subsequent operations.

BACKGROUND OF THE INVENTION

Many winding apparatuses require an operator to manually load cores onto a winding spindle in preparation for winding a web onto the core. Often the web is manually attached to the core via a slot in the core, or attached by the use of adhesive tape between the core and the web, or attached by the manual application of glue between the core and web, prior to winding. These approaches of cinching the web to the core are time consuming and are difficult to automate. U.S. Pat. No. 6,412,729 illustrates a rewinder mandrel system that teaches applying glue to the core, to enable web attachment. This approach does not lend itself to providing a web trailer end of a stock roll, which is not contaminated and not wrinkled.

Also, many winding apparatuses require an operator to manually wrap the last convolution of web around a completely wound stock roll, and then manually tape or glue the web leader to the stock roll to secure the web from unwinding. This approach taught in U.S. Pat. No. 6,412,729 is time-consuming and labor-intensive.

In both approaches described above, the core and tape or glue must be manually removed in subsequent operations. This is time-consuming as well, and again difficult to automate. Often, portions of the web that includes tape or glue may need to be cut off and discarded in subsequent operations, such as in a splicing operation, because the edges of the web leader and web trailer are contaminated. This can be wasteful and also difficult to automate.

In many industry applications, a web is wound to a specific length, and there is no need to cut the web leader and trailer ends in registration with other portions on the web, for example, perforations in the web. Also in most industry applications, the required accuracy of cutting the web leader or web trailer in relationship to these web perforations is not critical. However, in the photographic film industry, for example, there is a desire to provide specially prepared stock rolls of perforated web to an ultrasonic lap splicing operation, to simplify and automate the overall web handling process. In an effort to provide these prepared stock rolls of web in an automated fashion, there is a need to automatically load cores onto a winding spindle, cinch a web to a core without the use of tapes or glue, and to automatically tack down an outer convolution of the web to its stock roll. Also, providing stock rolls of web, with both web leader and web trailer ends cut in registration to their adjacent web perforations, eliminates the need to cut off the web at subsequent splicing operations, which greatly simplifies the down stream process of on-pitch splicing.

A common ultrasonic splicing device, used for motion picture film, is disclosed in U.S. Pat. No. 4,029,538. This ultrasonic splicing apparatus requires the operator to manually cut off the web trailer and web leader ends, and to discard them in preparation for splicing. Notably, providing prepared stock rolls of web, which would not require the cutting and discarding of this web, would greatly simplify the overall splicing process and be easier to automate. In U.S. Pat. No. 5,679,207 stock rolls of web are delivered to an automatic splicing system, which performs ultrasonic lap splicing on the web. However, the system is not capable of splicing perforated webs on pitch, and therefore the stock rolls do not have any special end cut registration requirements that would make this teaching feasible for the photographic industry where such registration requirements are critical.

Consequently, there is a need to automatically provide stock rolls of a perforated web, which have web leader and web trailer ends prepared (i.e., cut) for subsequent on-pitch registration and overlapping ultrasonic splicing. Also, there is a need to automatically generate stock rolls of web that do not unwind during handling or transport. There remains a need to automatically load cores onto a winding spindle, and then automatically cinch the web to the cores without the use of tapes, adhesives, glue or mechanical attachment in preparation for winding. Furthermore, there is a need to create stock rolls of web, which provide a means for acquiring the web leader of a stock roll for subsequent splicing operations.

SUMMARY OF THE INVENTION

The present invention is directed to overcoming one or more of the needs set forth above. Briefly summarized, one aspect of the present invention discloses an automatic web winding system for creating a registered perforated web stock roll, from a perforated web, that includes a web leader and a web trailer. The automatic web winding system herein, includes:

a) a die assembly that creates the web leader of a first web stock roll and the web trailer of a second web stock roll;

b) a winding assembly that automatically wraps and cinches the web trailer to an associated core prior to forming the second web stock roll; and c) a core loader assembly that automatically loads a core to the winding assembly and transfers the web trailer to winding assembly.

ADVANTAGES OF THE INVENTION

The present invention has the following advantages:

1 The invention "accurately" cuts the leading and trailing edges of web, in registration to the perforations in the web, to prepare the web for post-ultrasonic splicing operations. This technique provides less splice overlap variation in the ultrasonic lap splice process, and eliminates the need to remove any web preceding the splicing operation.

2 In one embodiment of the present invention, web punching of the edges on the web leader and web trailer can include additional features, which contour all the corners of the web leader and web trailer ends. These contoured corners ensure that subsequent ultrasonic splice welds do not extend beyond the width of the web, and thus are beneficial in subsequent down stream web handling operations.

3 The present invention provides a means to automatically tack down the web outer convolution to itself. This technique is a very simple, reliable and low cost method of automatically capturing the outer convolution of the stock roll of web. The present invention also provides a method of threading the web to the core. The threading operation maintains accurate lateral position of the web. This novel technique provides a reliable means of advancing the web to the core.

4 The present invention combines the automatic core loading process and the web threading process to simplify the system's operations and tooling required.

5 The present invention combines web cutting and adhesive tack down operations to further simplify the system's tooling and operations. This combination provides a consistent flap length of the web leader, which is helpful in grasping the web for a subsequent operation.

6 The present invention utilizes a cinching approach that eliminates the web from sticking out beyond the sidewalls of the core.

7 When combined with innovative roll handing techniques, multiple rolls of web can be wound and unloaded automatically.

8 If needed, this system can be reconfigured as a web "surface winding" system.

9 The present invention provides a simplistic singular winding spindle design, which simplifies unloading requirements of a finished roll, and reduces hardware costs. The singular spindle design also can reduce the required floor space.

These and other aspects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
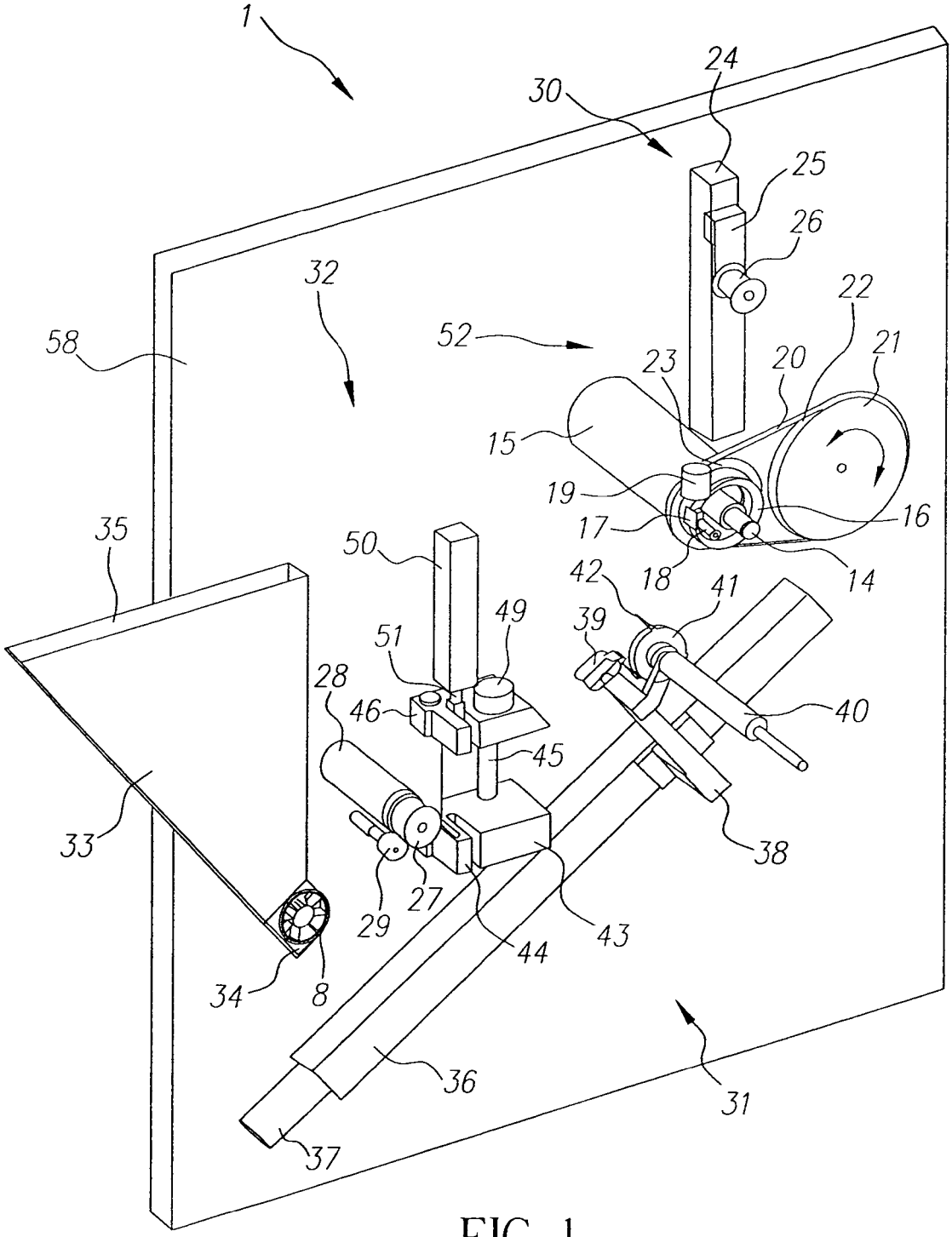
FIG. 1 is a perspective view of the overall automatic winding system and its components according to the present invention.
Figure 3:
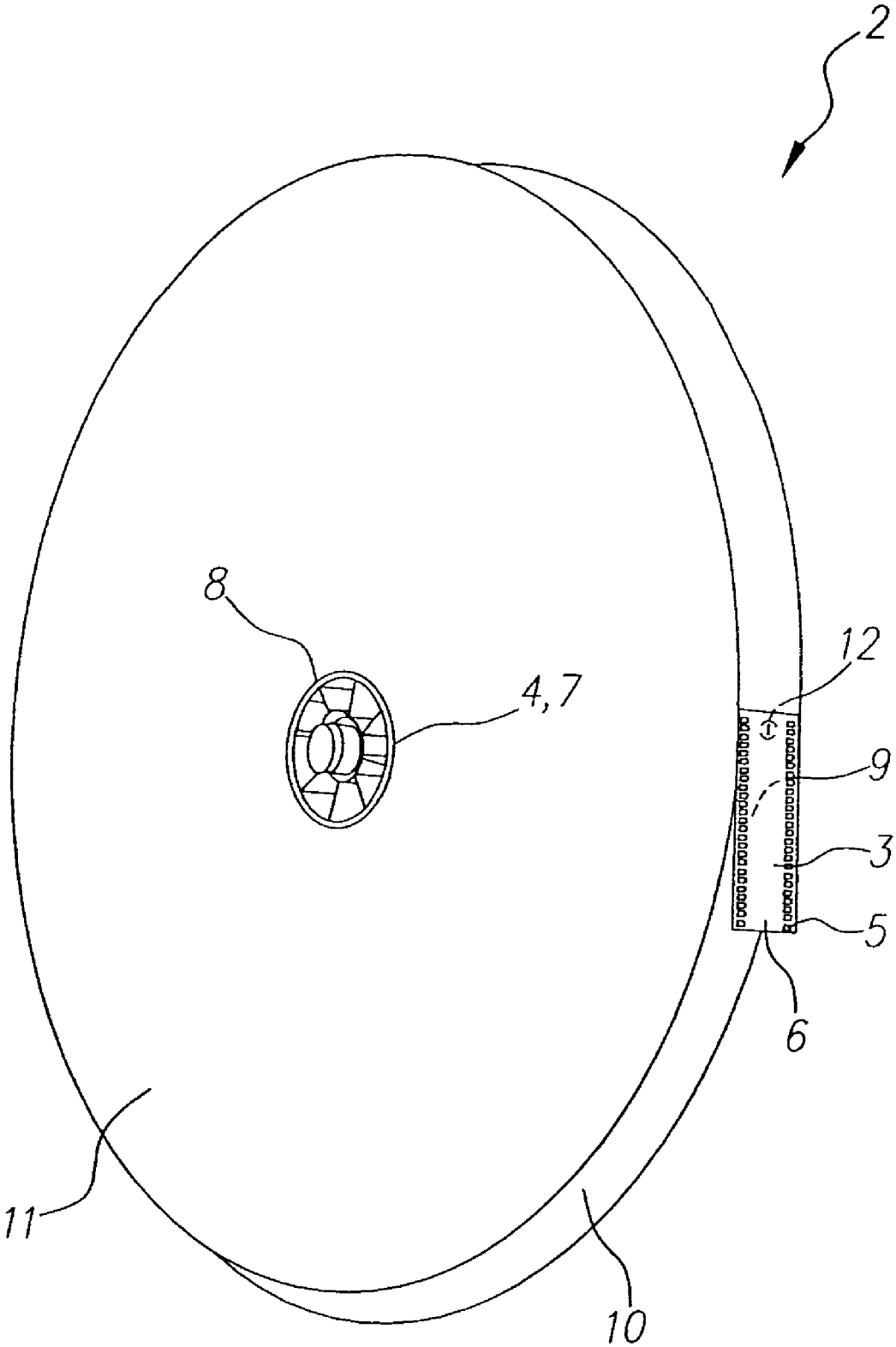
FIG. 3 is a perspective view of the completed wound web stock roll.

The purpose of the automatic winding system 1, seen in FIG. 1, is to automatically create web stock rolls 2 of perforated web 53, shown in FIG. 3, which can be easily handled automatically at subsequent web stock roll handling and splicing operations.

The automatic winding system 1, consists of a winding assembly 52, which has a winding spindle 14 driven by a winding drive 15. The winding spindle 14 can actuate to engage the inner diameter of a core 8 of stock roll 2, shown in FIG. 3. The winding drive 15 can operate in a variable torque mode to provide winding web tension control. The winding assembly 52, shown in FIG. 5, also has an cinching roller 18, which provides an automatic means of wrapping the starting web trailer 4 (shown in FIG. 4) of the web stock roll 2 around the core 8 (shown in FIG. 3).

Above the winding assembly 52 is a builder roller assembly 30, which applies an additional cinching force to the web trailer 4 and core 8, and also provides a means of building web stock rolls 2 of perforated web 53 with flat sidewalls. Another function of the builder roller assembly 30 is to apply a force to tack the leader adhesive feature 12 to the outer convolution of the web stock roll 2.

The die assembly 32 cuts the web leader and web trailer edges (6,7 respectively) in registration to the web perforations 5. The die assembly also incorporates a sprocket 27, which is driven by its associated sprocket drive 28. The sprocket 27 and its associated sprocket drive 28 meters the perforated web 53 during the winding process, and accurately positions (registers) the web perforations 5 to the die slot 44. Also, included within the die assembly 32 is an adhesive applicator and its associated adhesive reservoir (48,49), shown in FIG. 2, which applies a leader adhesive feature 12 to a portion of the web leader 3, which is used to tack the outer convolution of the web stock roll 2 to itself (shown in FIG. 3).

A simple core hopper 33 is provided to hold a queue of cores 8 for automatic core loading.

The core loader assembly 31, shown in FIG. 1, provides a means of picking a single core 8 from the core hopper 33, and placing the core 8 onto the winding spindle 14. Also incorporated in the core loader assembly 31, is the web vacuum head 39, which acquires the web trailer 4, via vacuum pressure, and threads the web trailer 4 from the die assembly 32 to the winding assembly 52.

Web Stock Roll

Figure 4:
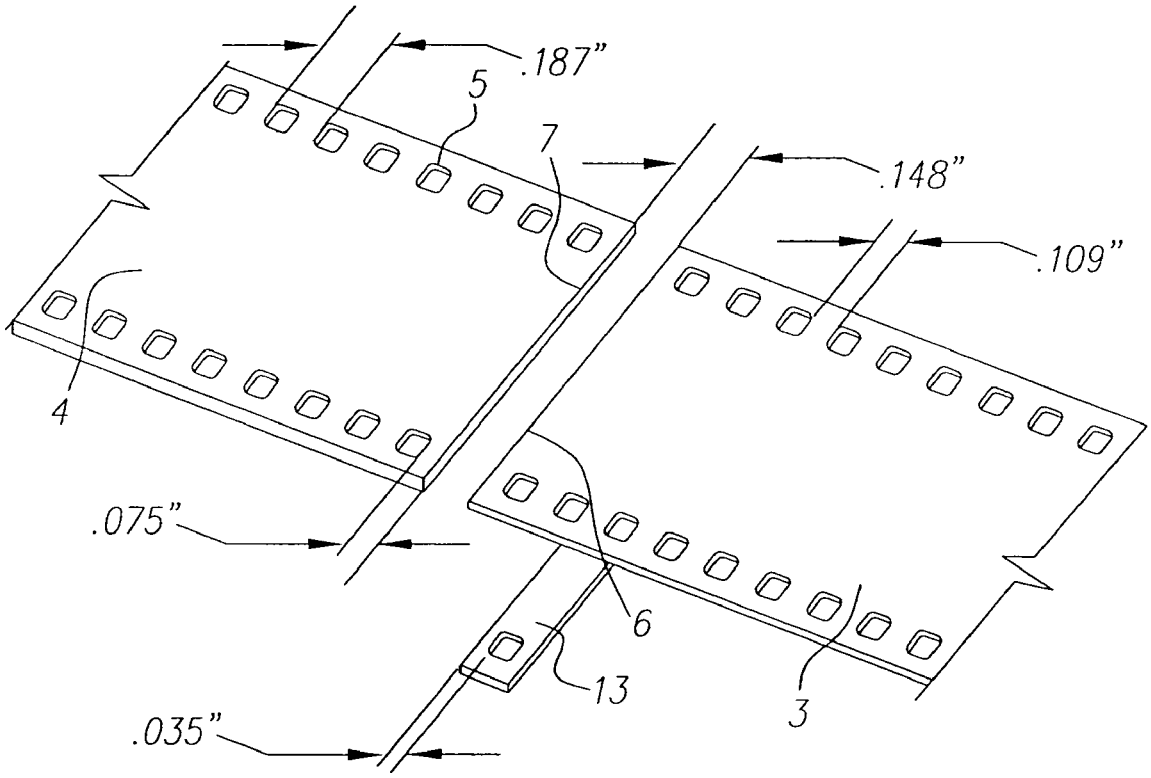
FIG. 4 is a dimensioned (in inches) perspective view of a 35 mm motion picture film (web) and its web punch slug sized for a 0.041" nominal overlap splice.

The web stock roll 2, shown in FIG. 3, consists of a roll of web 11, a core 8, and a leader adhesive feature 12. The leader adhesive feature 12 is designed to hold the outer convolution of web to its roll of web 11, and create a loose flap of web of a specific length, which is from the web leader edge 6 to the leader adhesive feature 12. It is desirable to have the leader adhesive feature 12 capable of peeling cleanly off the roll 11, without leaving residue (cleanly), when the web leader 3 is pulled away from the wound web stock roll 2, during subsequent operations. It is also desirable to have the leader adhesive feature 12 remain on the web leader 3 when peeled (sticking to the web facing in side 9, and not the web facing out side 10). As a result, the leader adhesive feature 12 will remain adjacent to the web leader edge 6, during any subsequent web splicing operations. The web trailer 4, which is cinched to the core 8, should also come off the core cleanly (with out tape stuck to it, for example) in subsequent operations. Both the web leader edge 6 and the web trailer edge 7 should, preferably, be precut to a specific dimension relative to the web perforations 5, as illustrated in FIG. 4 (an example of a cut 35 mm motion picture film web), to generate a lap joint 54, which is made in subsequent operations, as shown in FIG. 22C and FIG. 23B.

Winding Assembly

Figure 5:
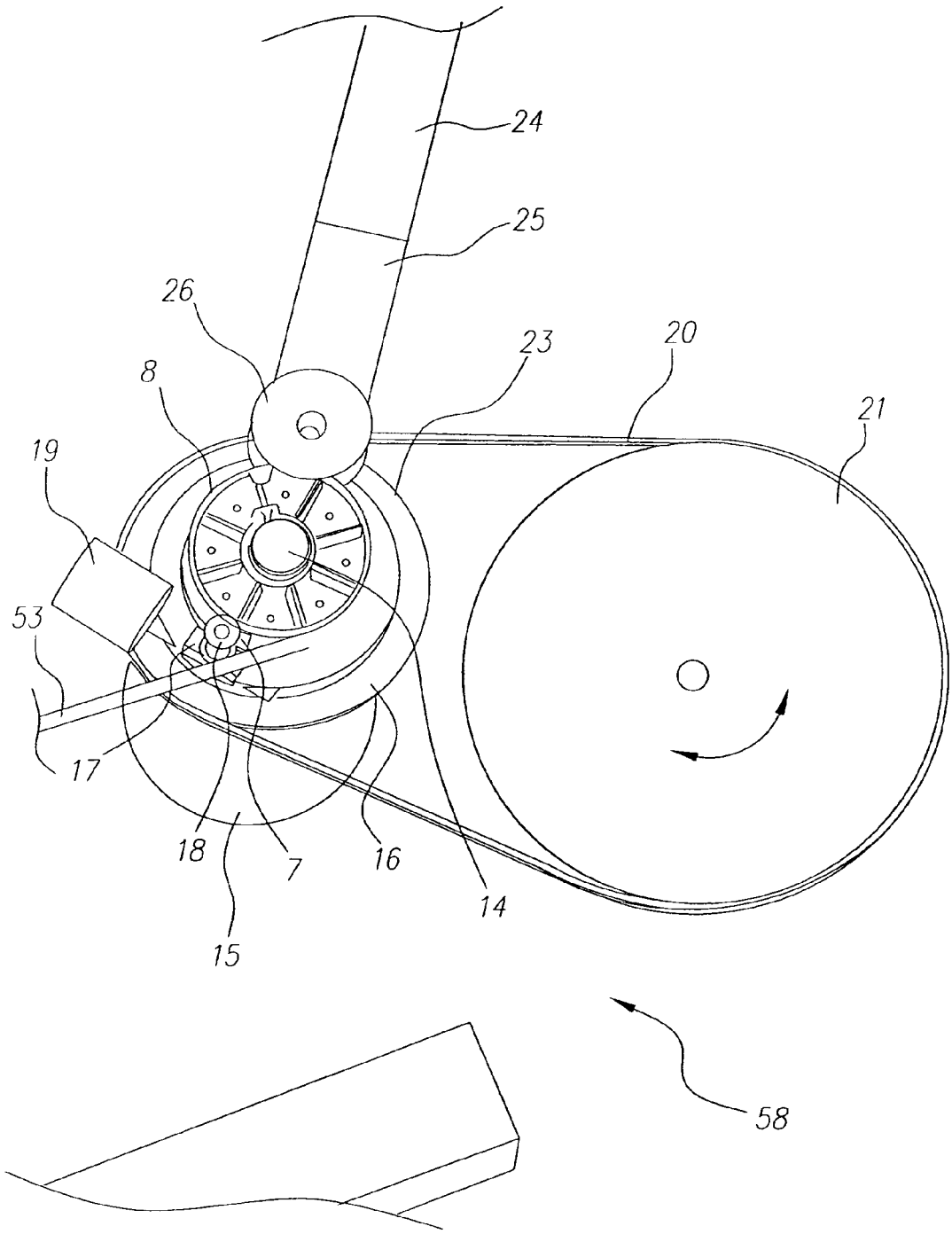
FIG. 5 is a perspective view of the wind assembly and builder roller assembly.
Figure 6:
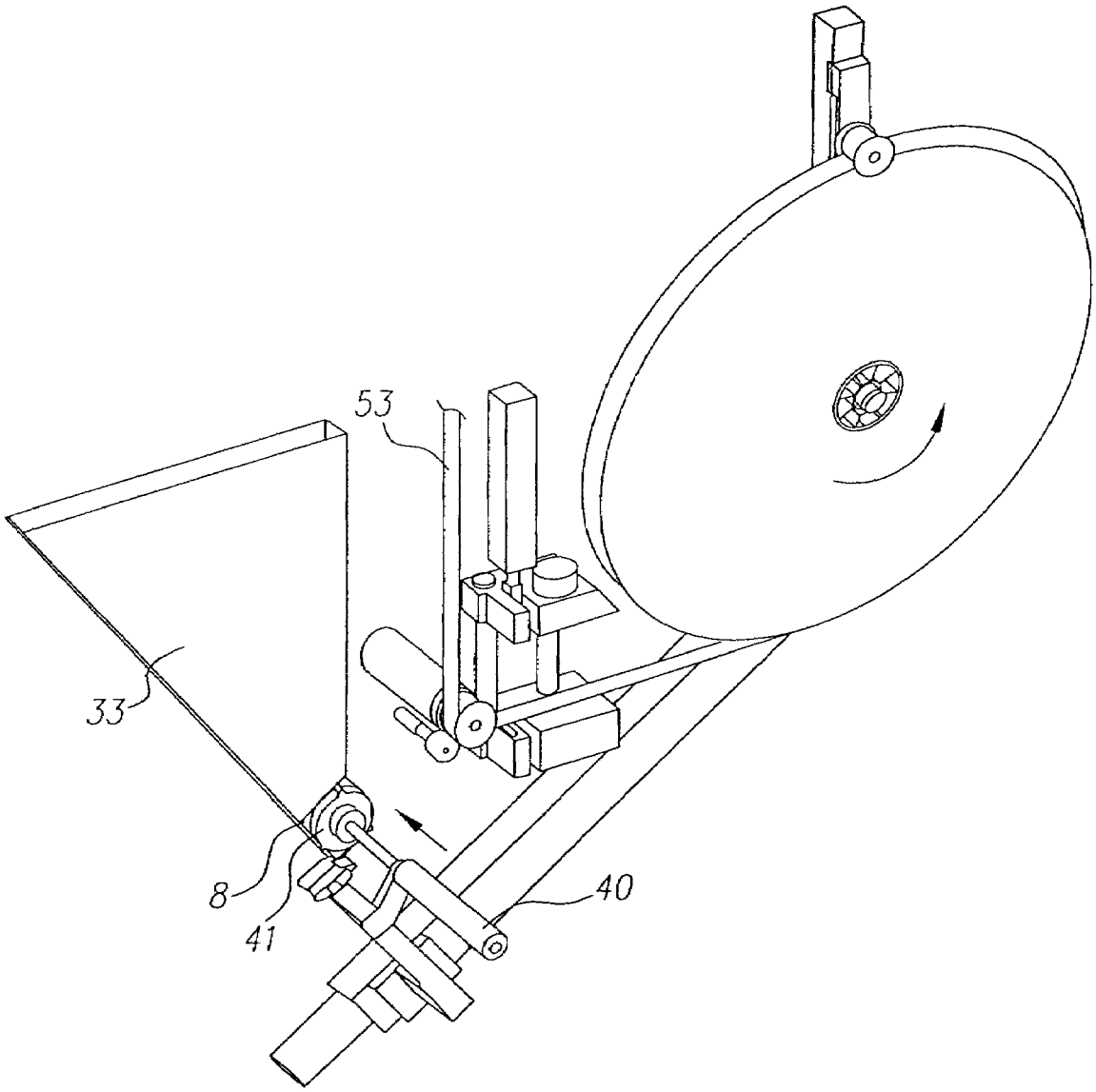
FIG. 6 is a perspective view of the automatic winding system illustrating steps 1 and 2 of the process.
Figure 7:
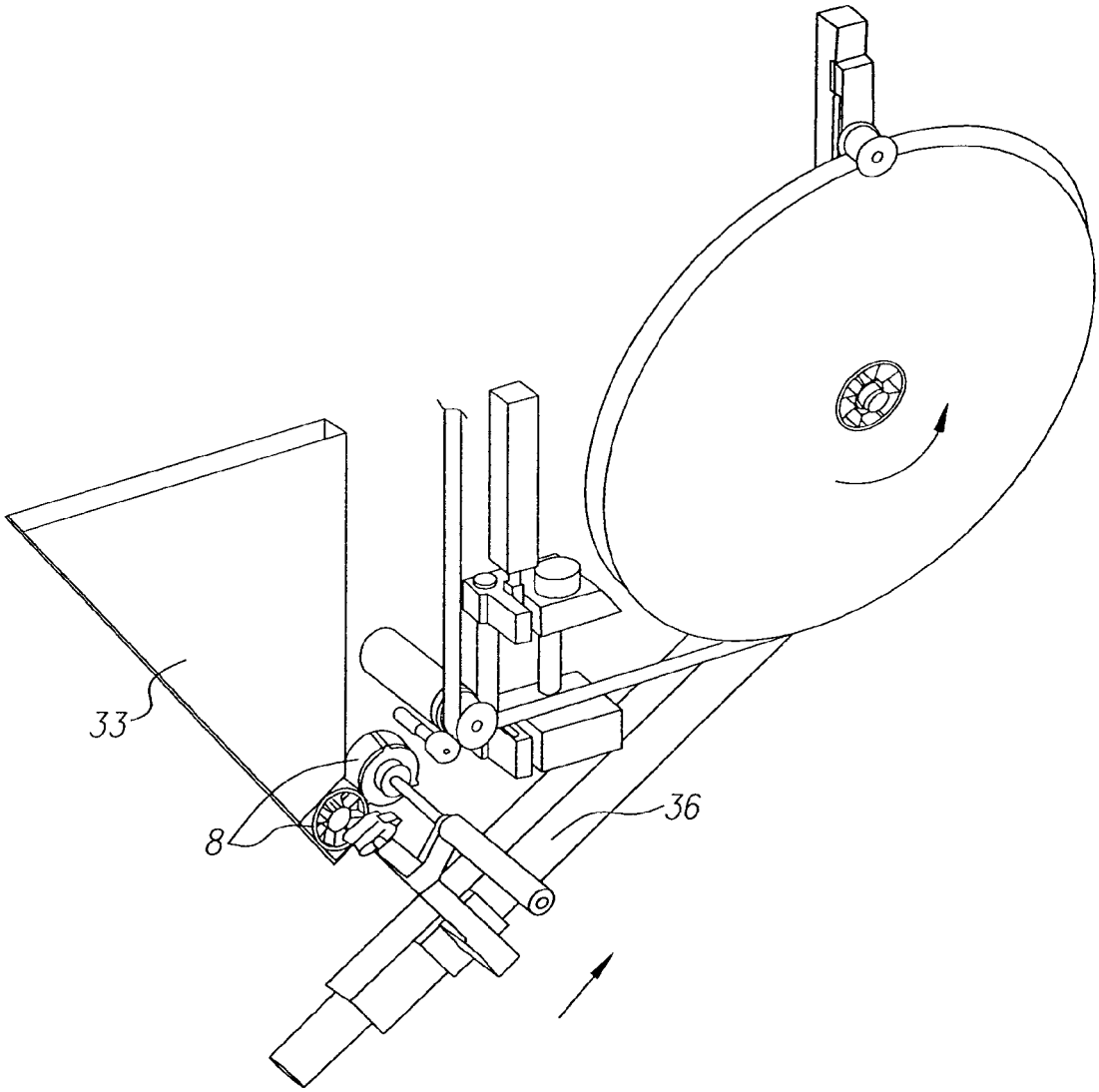
FIG. 7 is a perspective view of the automatic winding system, illustrating step 3 of the process.
Figure 8:
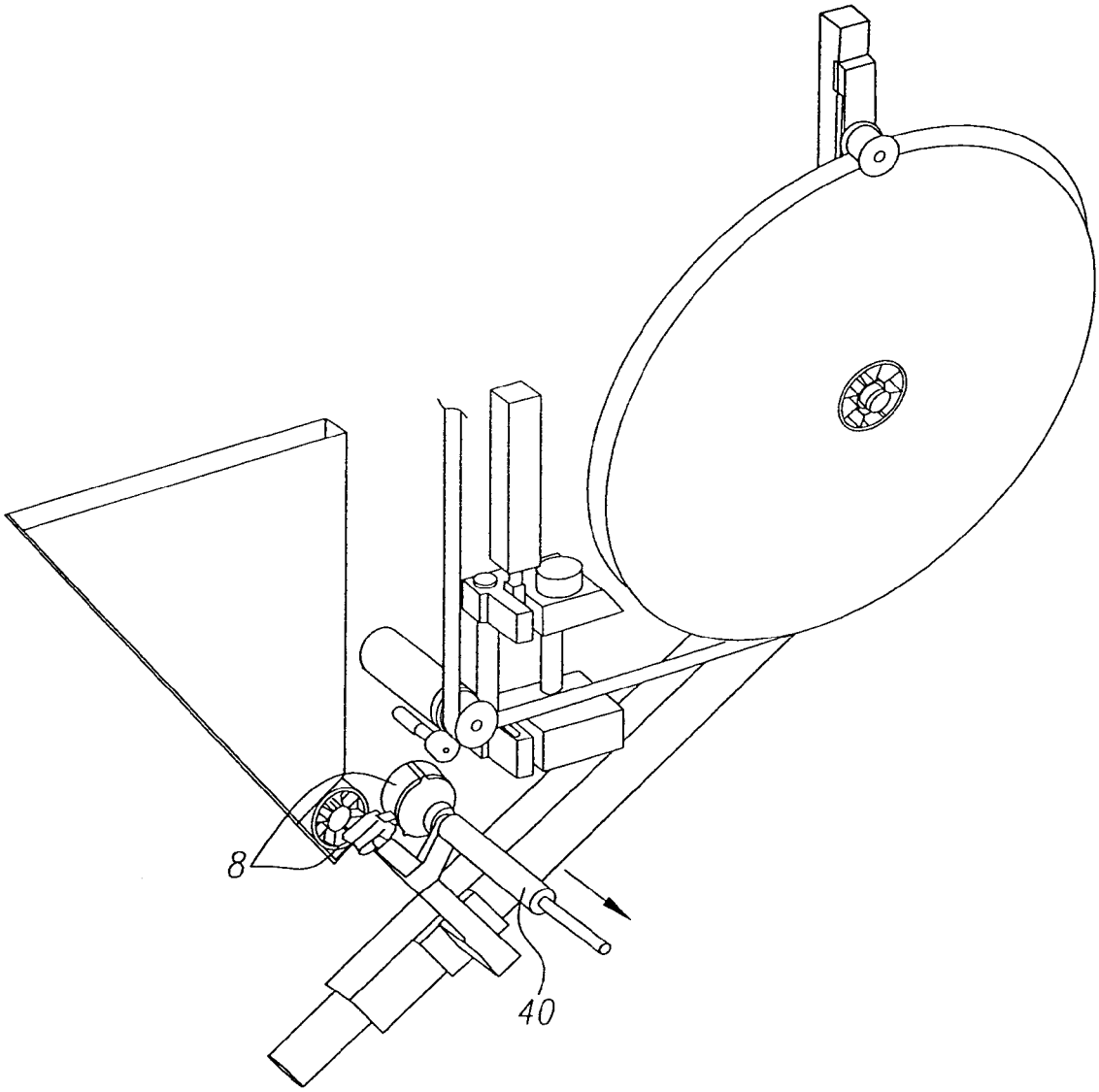
FIG. 8 is a perspective view of the automatic winding system illustrating step 4 of the process.
Figure 9:
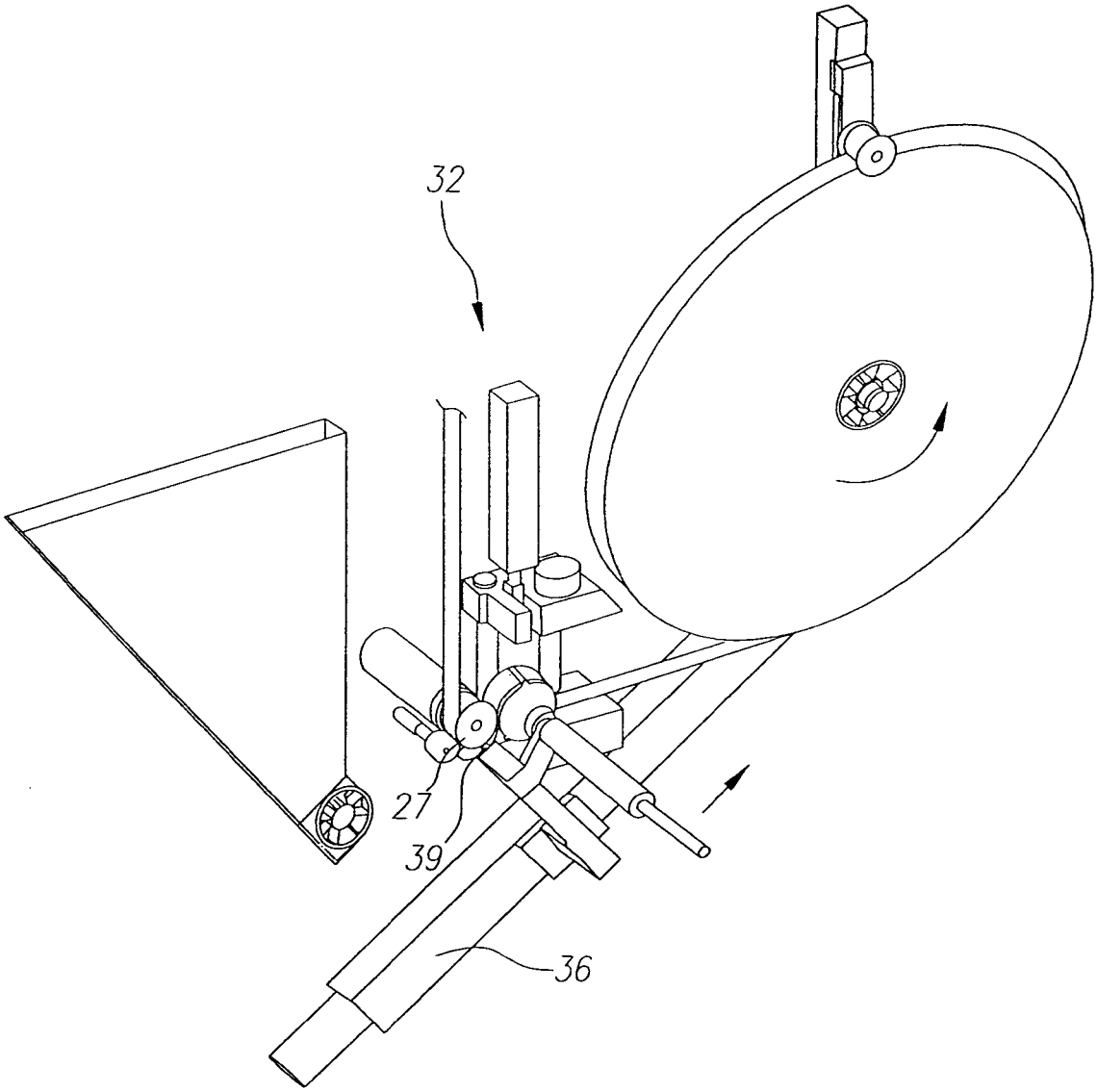
FIG. 9 is a perspective view of the automatic winding system illustrating steps 5-7 of the process.
Figure 10:
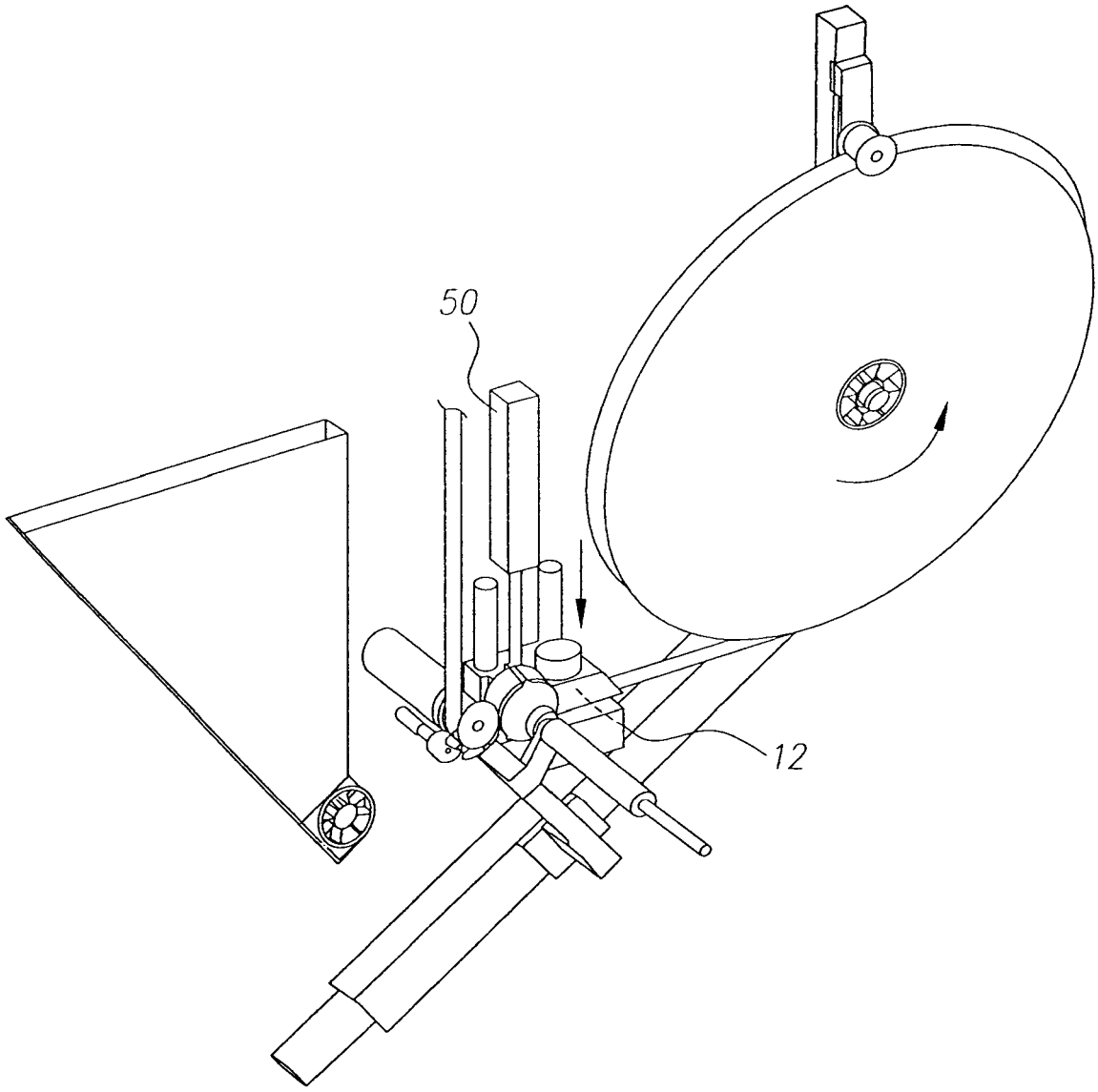
FIG. 10 is a perspective view of the automatic winding system, illustrating step 8 of the process.
Figure 11:
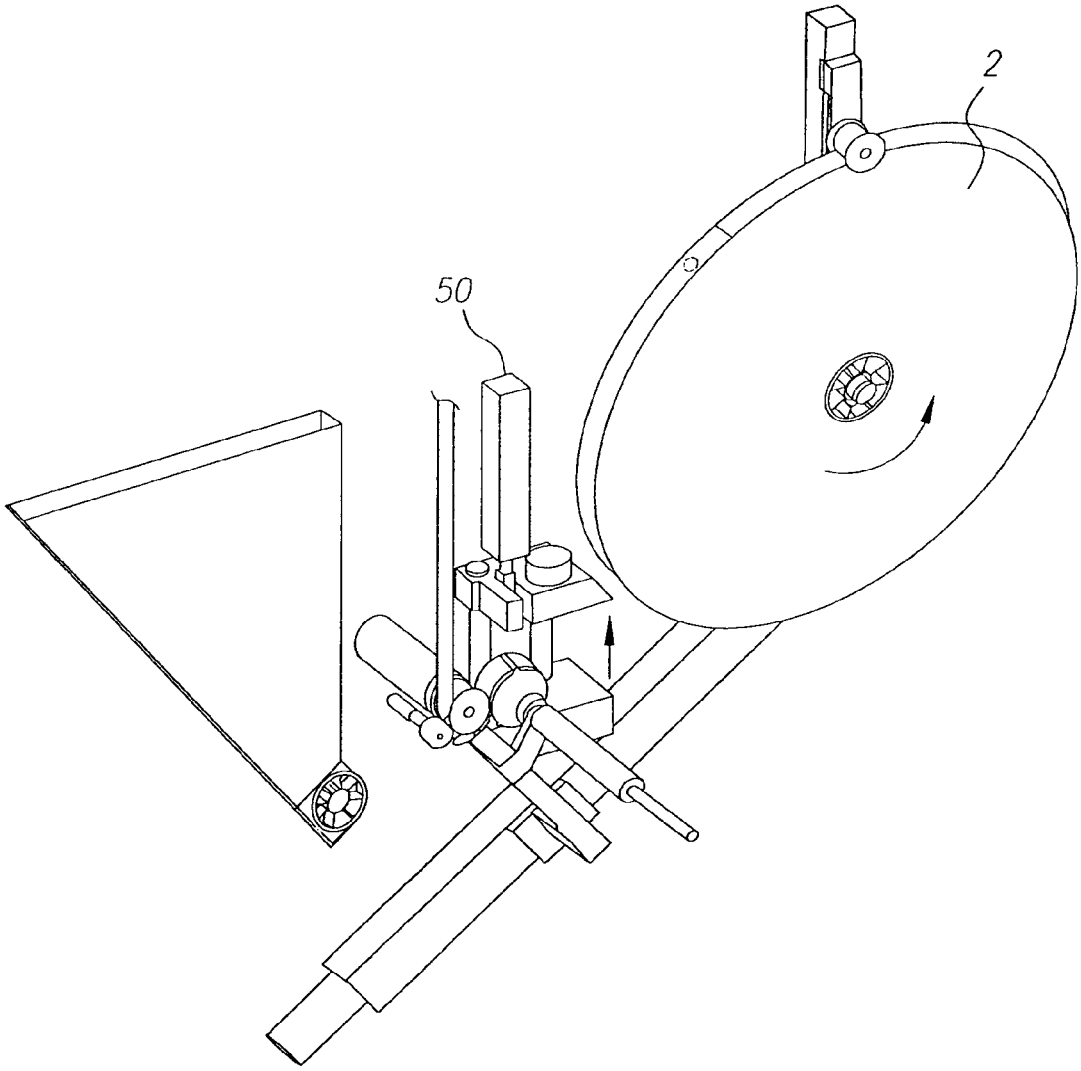
FIG. 11 is a perspective view of the automatic winding system illustrating steps 9 and 10 of the process.
Figure 12:
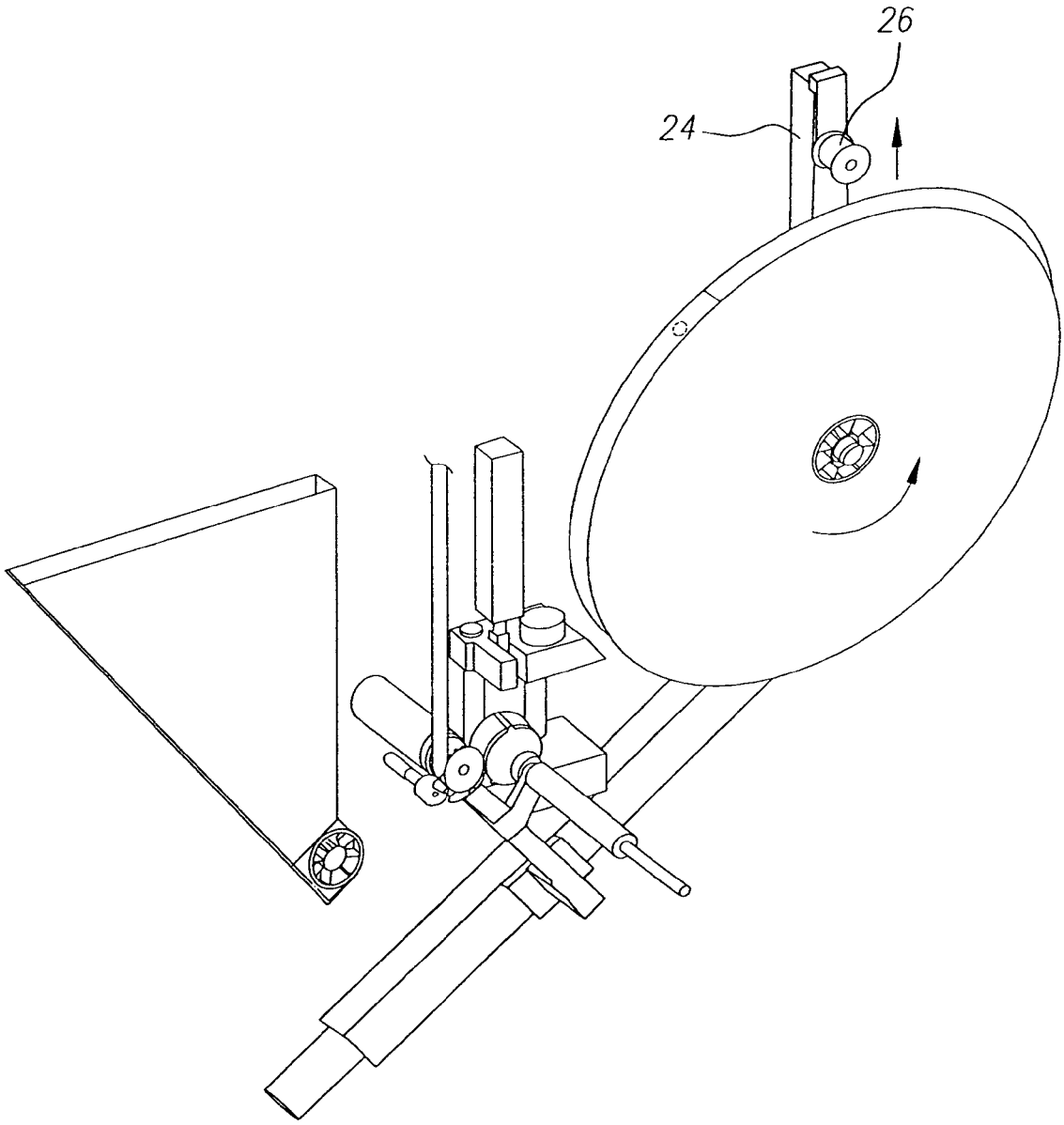
FIG. 12 is a perspective view of the automatic winding system illustrating step 11 of the process.
Figure 13:
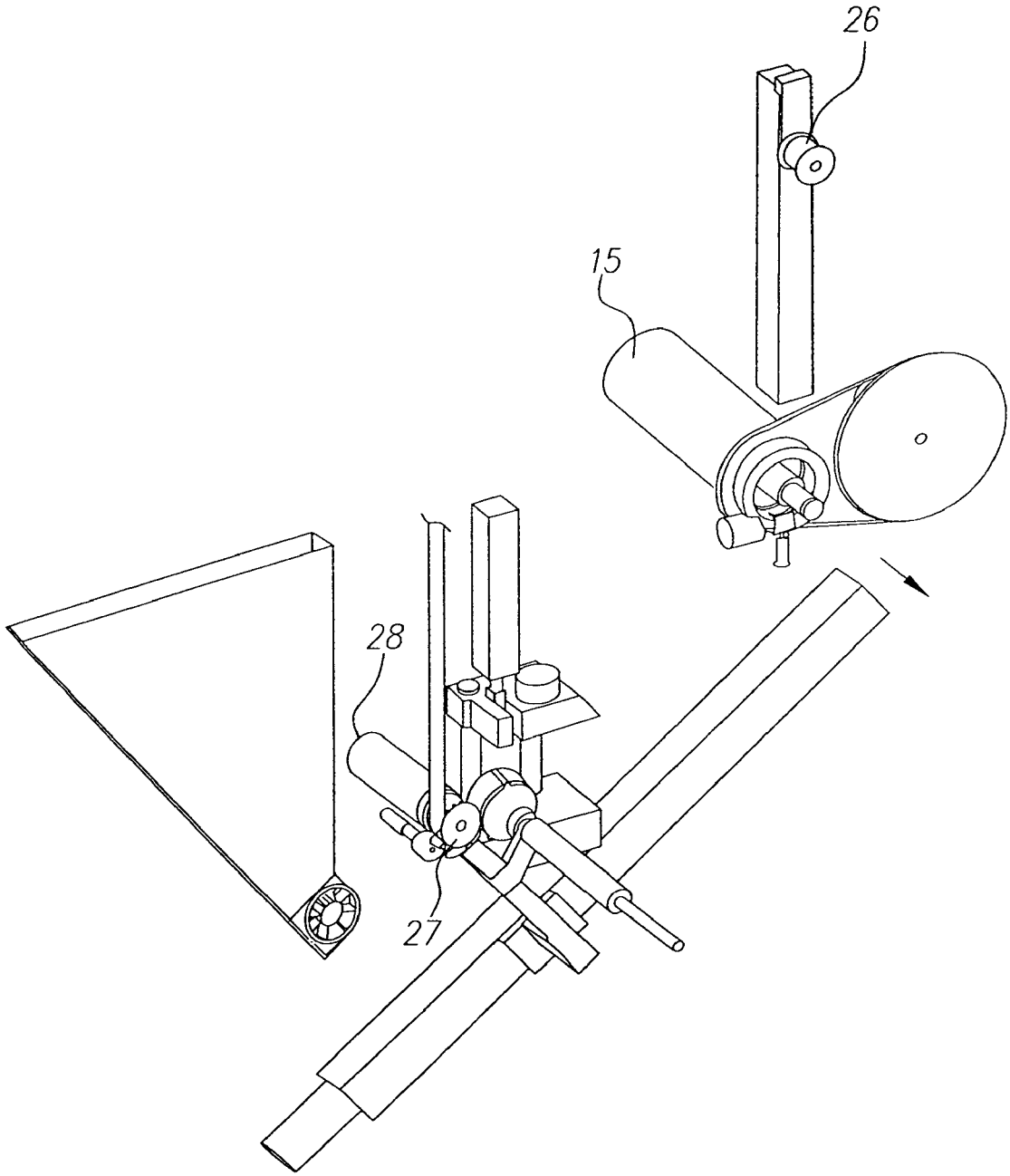
FIG. 13 is a perspective view of the automatic winding system illustrating step 12 of the process.
Figure 14:
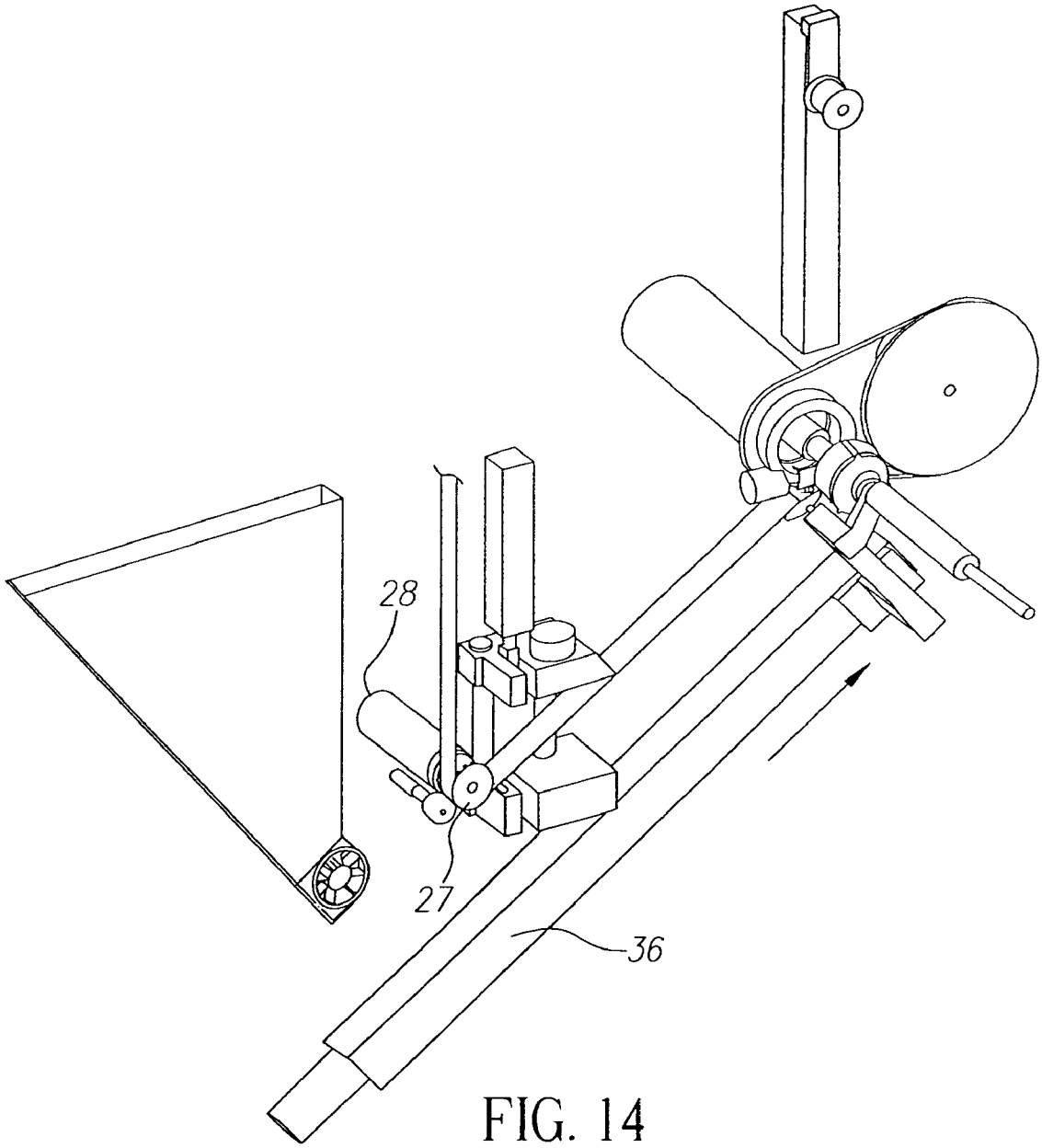
FIG. 14 is a perspective view of the automatic winding system illustrating step 13 of the process.
Figure 15:
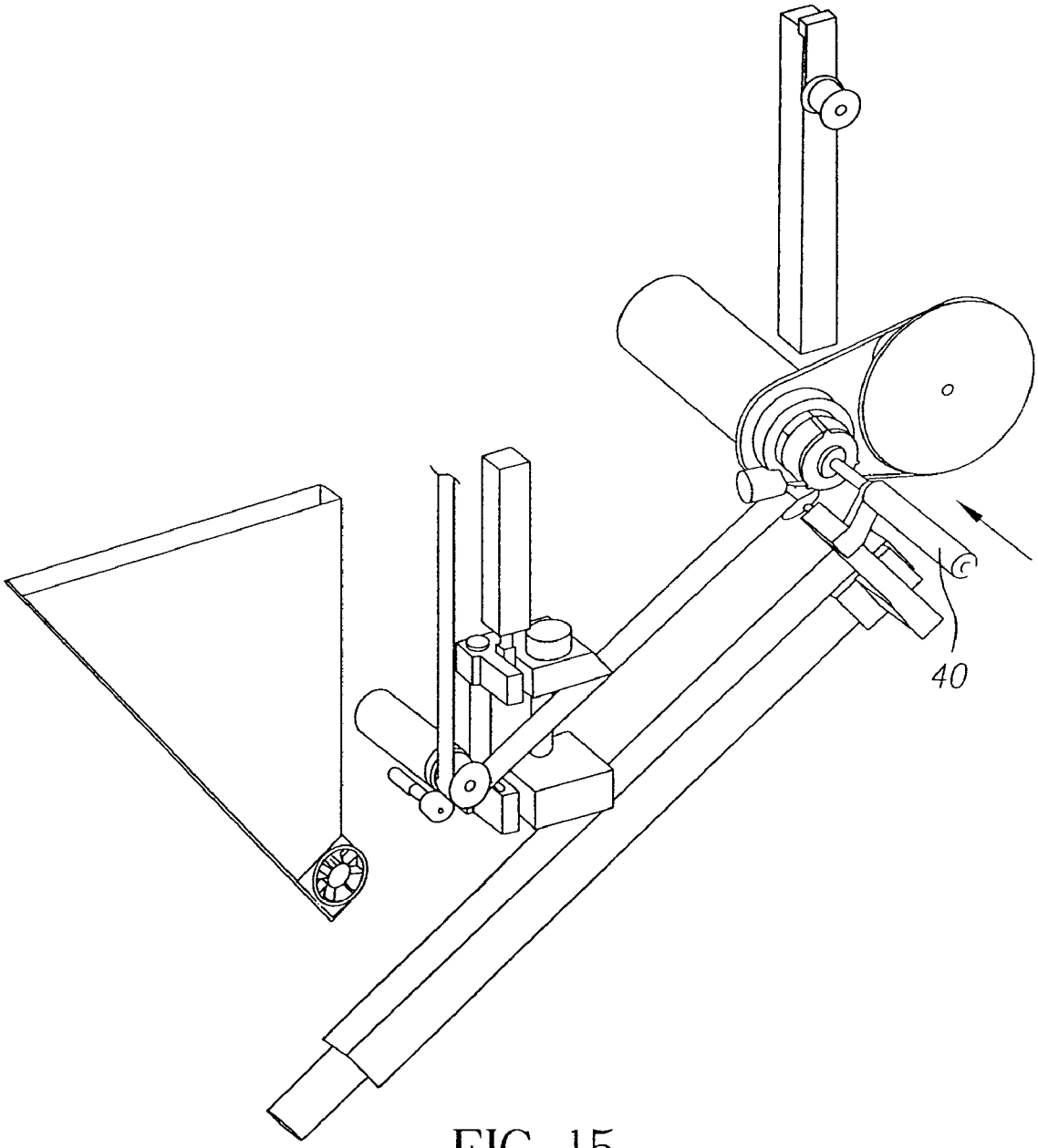
FIG. 15 is a perspective view of the automatic winding system illustrating steps 14 and 15 of the process.
Figure 16:
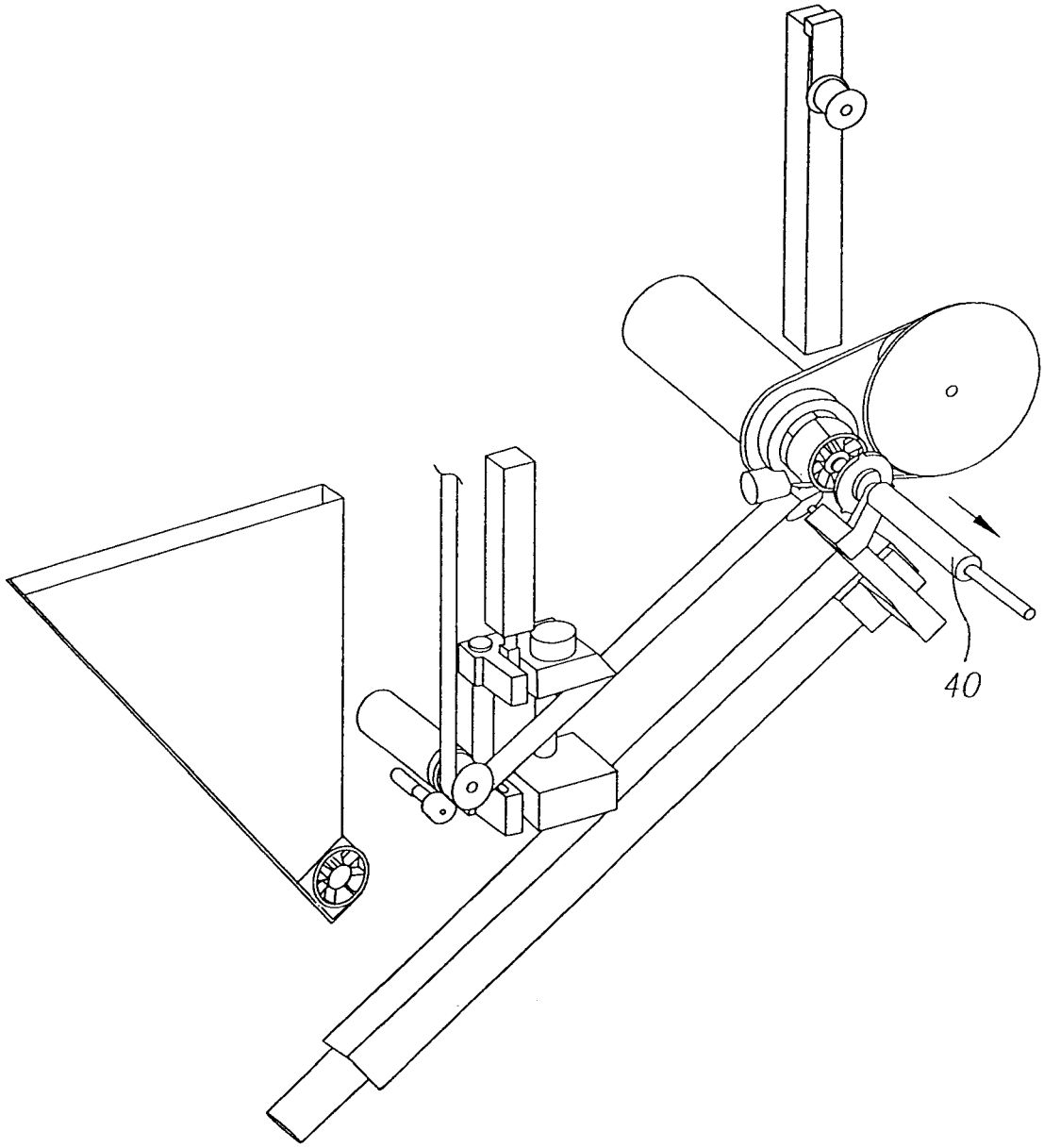
FIG. 16 is a perspective view of the automatic winding system illustrating step 16 of the process.
Figure 17:
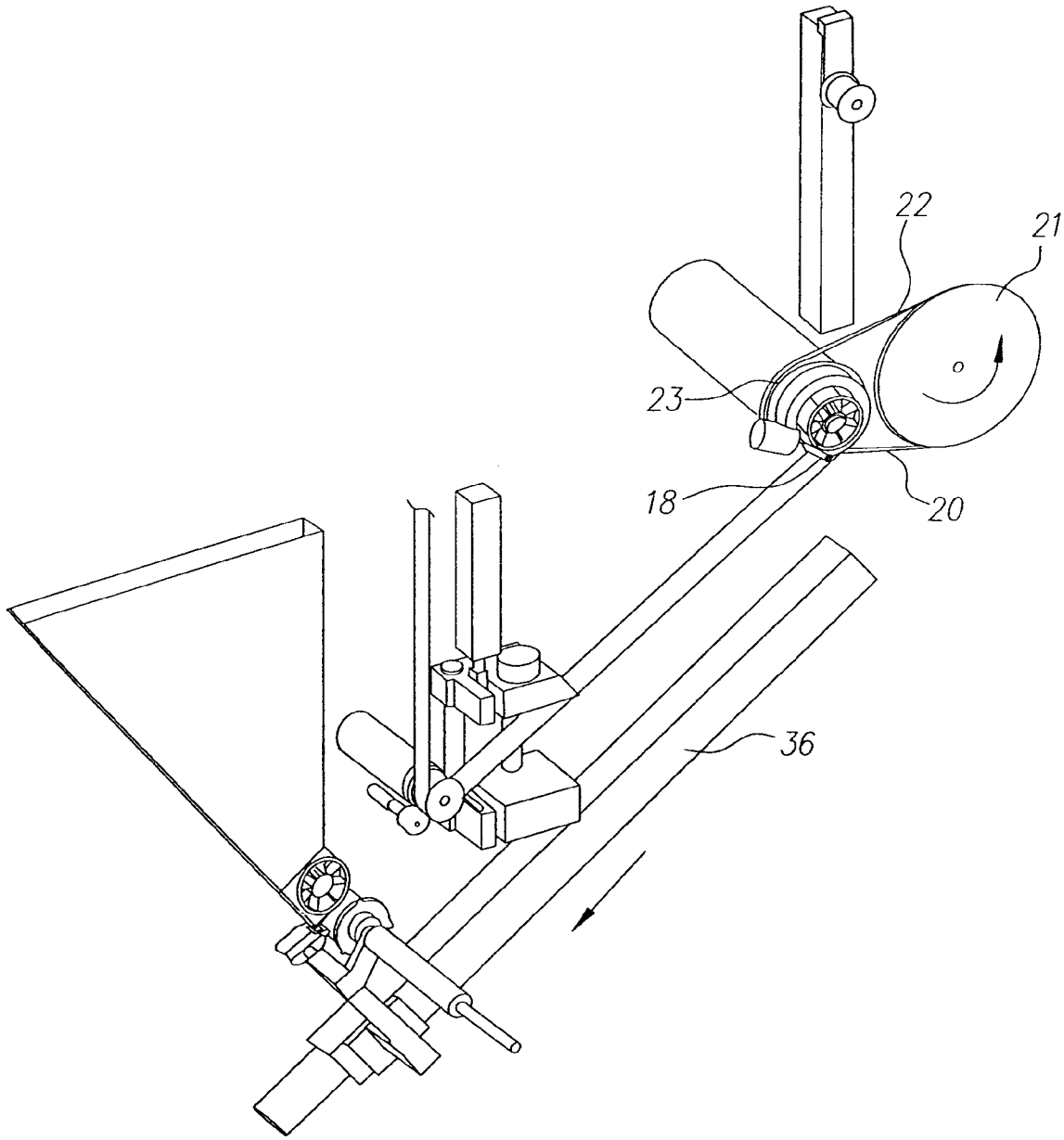
FIG. 17 is a perspective view of the automatic winding system illustrating steps 17-20 of the process.
Figure 18:
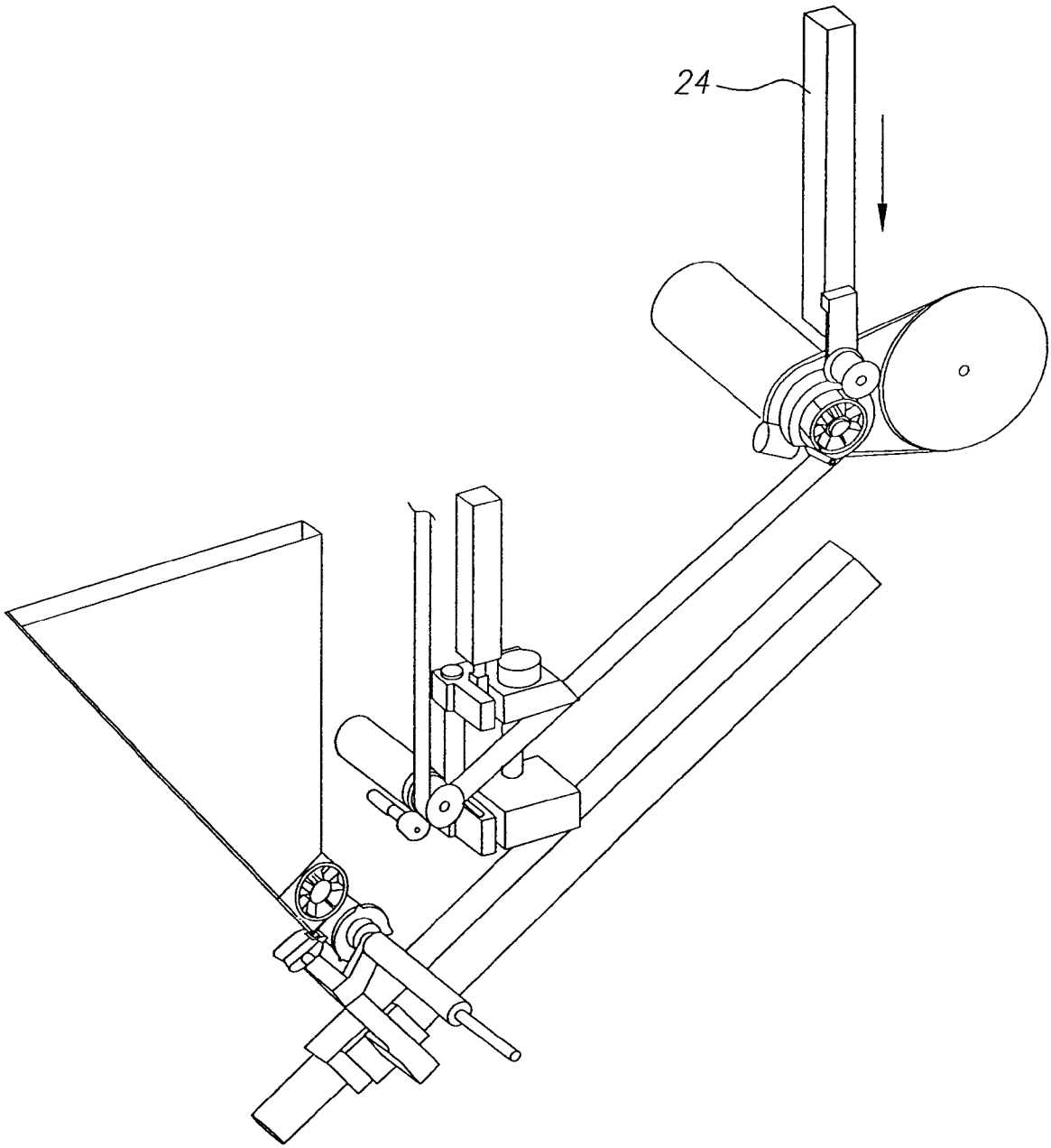
FIG. 18 is a perspective view of the automatic winding system illustrating steps 21-23 of the process.
Figure 19:
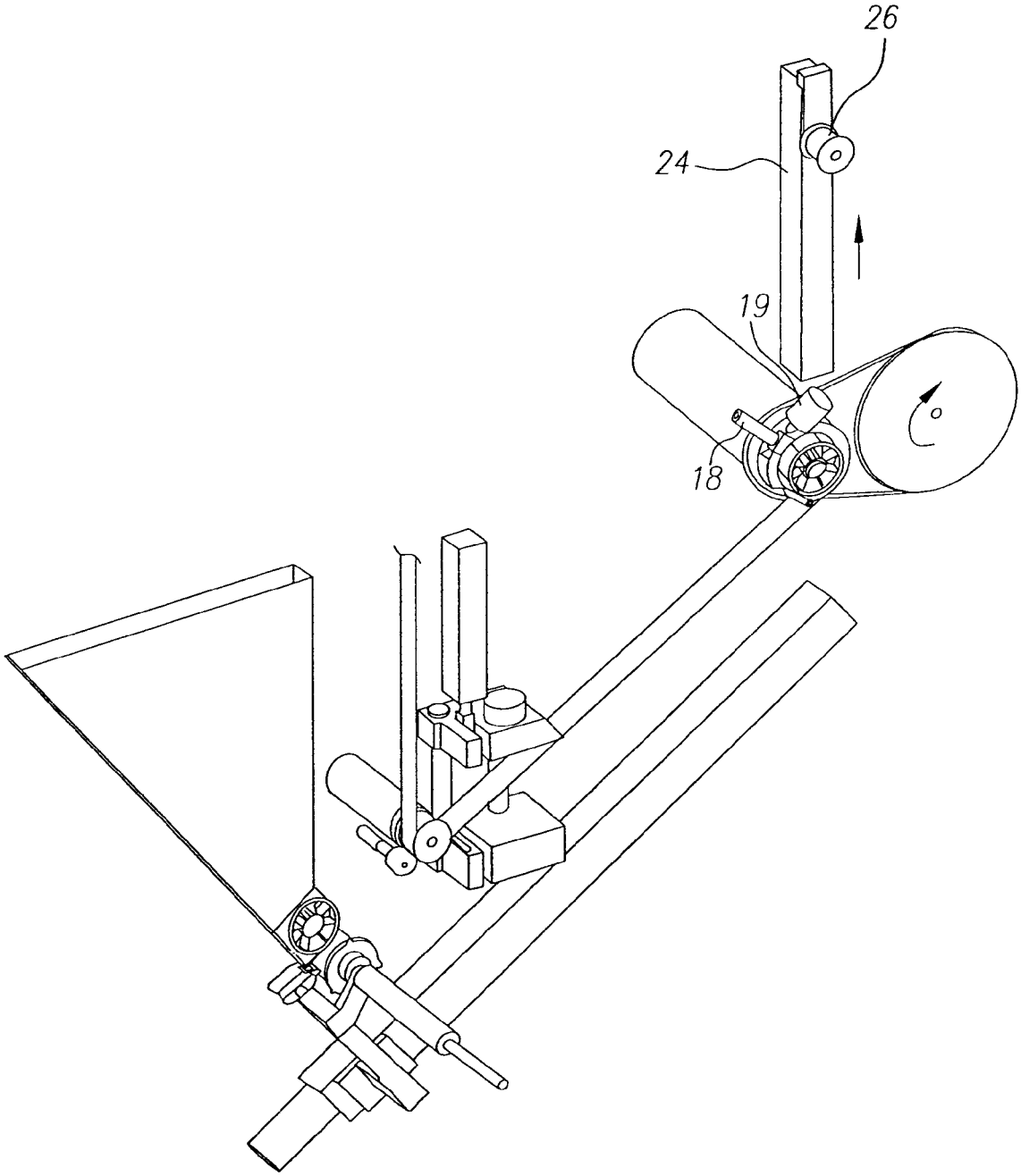
FIG. 19 is a perspective view of the automatic winding system illustrating steps 24 and 25 of the process.
Figure 20:
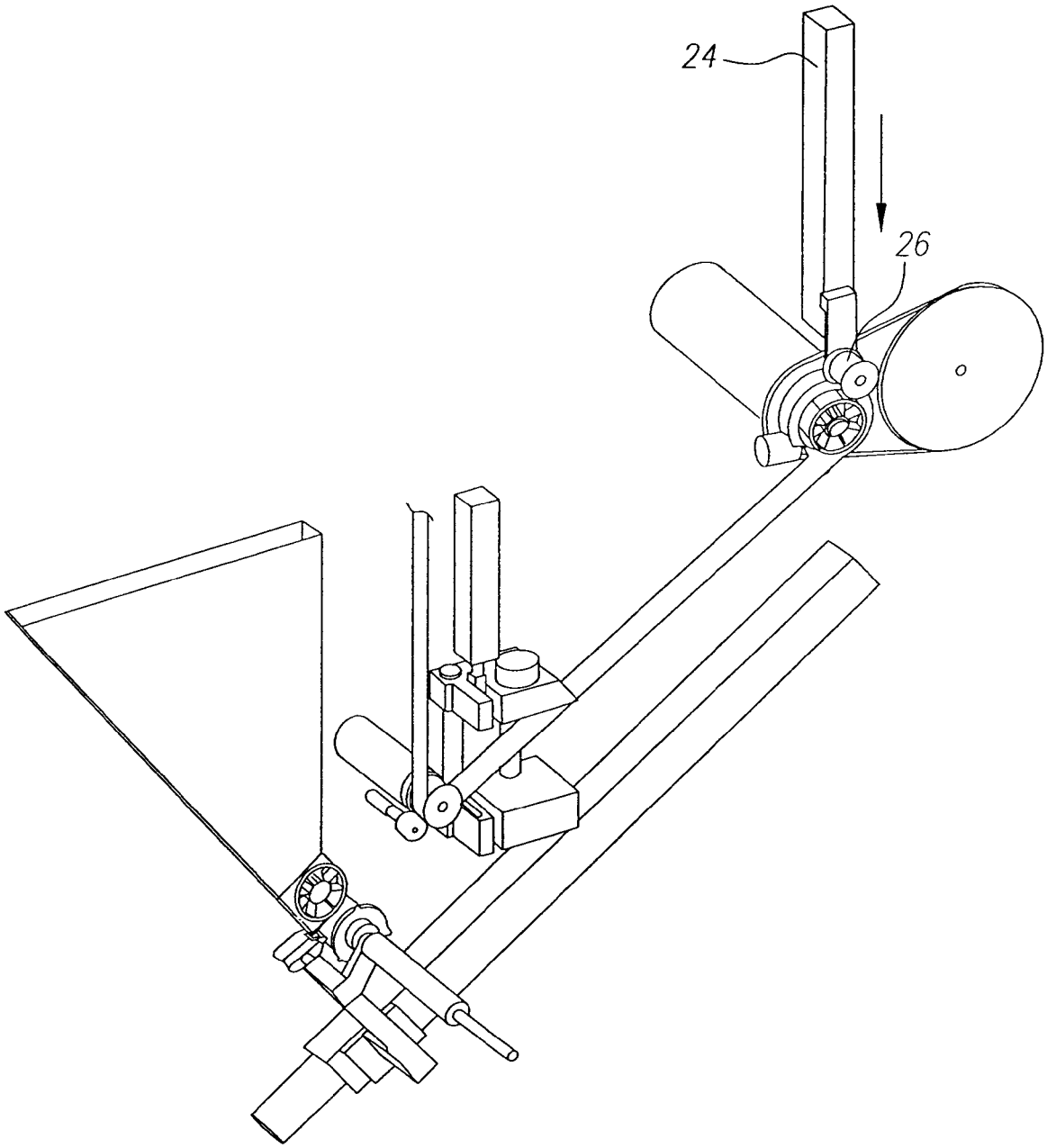
FIG. 20 is a perspective view of the automatic winding system illustrating step 26 of the process.
Figure 21:
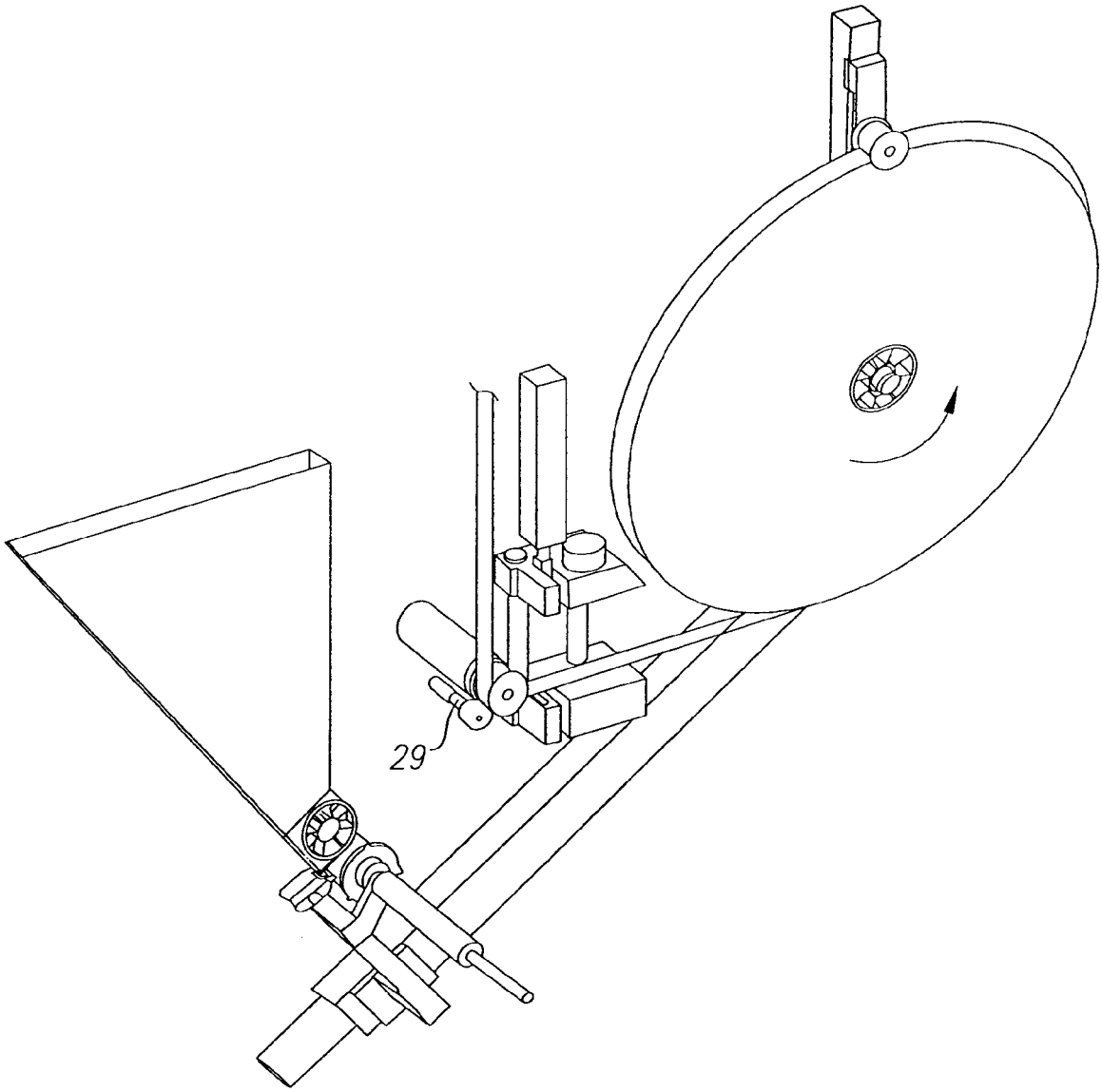
FIG. 21 is a perspective view of the automatic winding system illustrating step 27 of the process.

In addition to the winding spindle 14 and winding drive 15, the winding assembly 52, illustrated in FIG. 5, has an cinching roller 18. The cinching roller 18 is supported by the cinching roller arm 17, which swings outwardly approximately 90 degrees, so the cinching roller 18 aligns and is in contact with the core 8 on the wind spindle 14. When the cinching roller arm actuator 19 retracts the cinching roller arm 17 and its associated cinching roller 18, they both swing behind the web path, and the axis or the cinching roller 18 is then at an approximately 90 degree angle relative to the wind spindle 14 axis. The cinching roller arm 17 is supported by the cinching roller support 16, and the cinching roller support 16 is pivotally mounted to the machine frame 58. The center of rotation of the cinching roller support 16 is about the center of rotation of the wind spindle 14. Attached to the cinching roller support 16 is a driven pulley 23. The driven pulley 23 is belted to a drive pulley 21 by belt 20. The drive pulley 21 is actuated by a rotary actuator 22, which is mounted to the machine frame 58 of automatic unwinding system 1 (shown in FIG. 1).

The rotary actuator 22 has two stop positions, which control the planetary rotation of the cinching roller 18. A first stop position of the cinching roller 18 is approximately at a 6 o'clock, and a second stop position is at an approximately 7 o'clock. The CCW motion of the rotary actuator 22 wraps the web trailer 4 around the core 8, and places the web trailer edge 7 very close to the core 8 and nip formed by the perforated web 53 and core 8, in other words, in preparation for automatic insertion and cinching.

Builder Roll Assembly

The builder roller assembly 30, shown in FIG. 1 and FIG. 5, is mounted to the machine frame 58 of automatic winding system 1, and includes a builder roller actuator 24, which can be actuated at a set force. The moving portion of the builder roller actuator 24 has a builder roller support 25, which supports the builder roller 26. The builder roller 26 has flanges, which provide web guidance during web winding, and in turn creates web stock rolls 2 with flat sidewalls.

Core Loader Assembly

The core loader assembly 31, shown in FIG. 1, is mounted to the machine frame 58 of automatic winding system 1. The core loader assembly 31 has a core loader actuator 36, which is driven by core loader drive 37. The core loader drive 37 has positional control via an internal encoder not shown. Attached to the sliding feature of the core loader actuator 36, is a support arm 38, which extends upward. The support arm 38 rigidly supports a web vacuum head 39, which has vacuum porting to a valve and vacuum supply not shown. The web vacuum head 39 is designed to hold the trailer end 4 of the perforated web 53, which is created by the actuation of die assembly 32.

Also attached to support arm 38 is a core loader cylinder 40, which has a core loader support 41 mounted to its rod end. The stroke of the core loader cylinder 40 is parallel to the axis of the winding spindle 14. The core loader support 41 has porting to a valve and vacuum supply not shown, which provides a holding force to engage the core 8. Also, included on the core loader support 41 is a plurality of fingers 42, which support the outside diameter of the core 8 while it is being transferred.

The centerline axis of the core loader support 41, aligns with the centerline axis of core 8 at the pick position of the core hopper 33. The centerline axis of the core loader support 41 can also align with the axis of the winding spindle 14, when the core loader actuator 36 stops at the core place position.

Die Assembly

Figure 2:
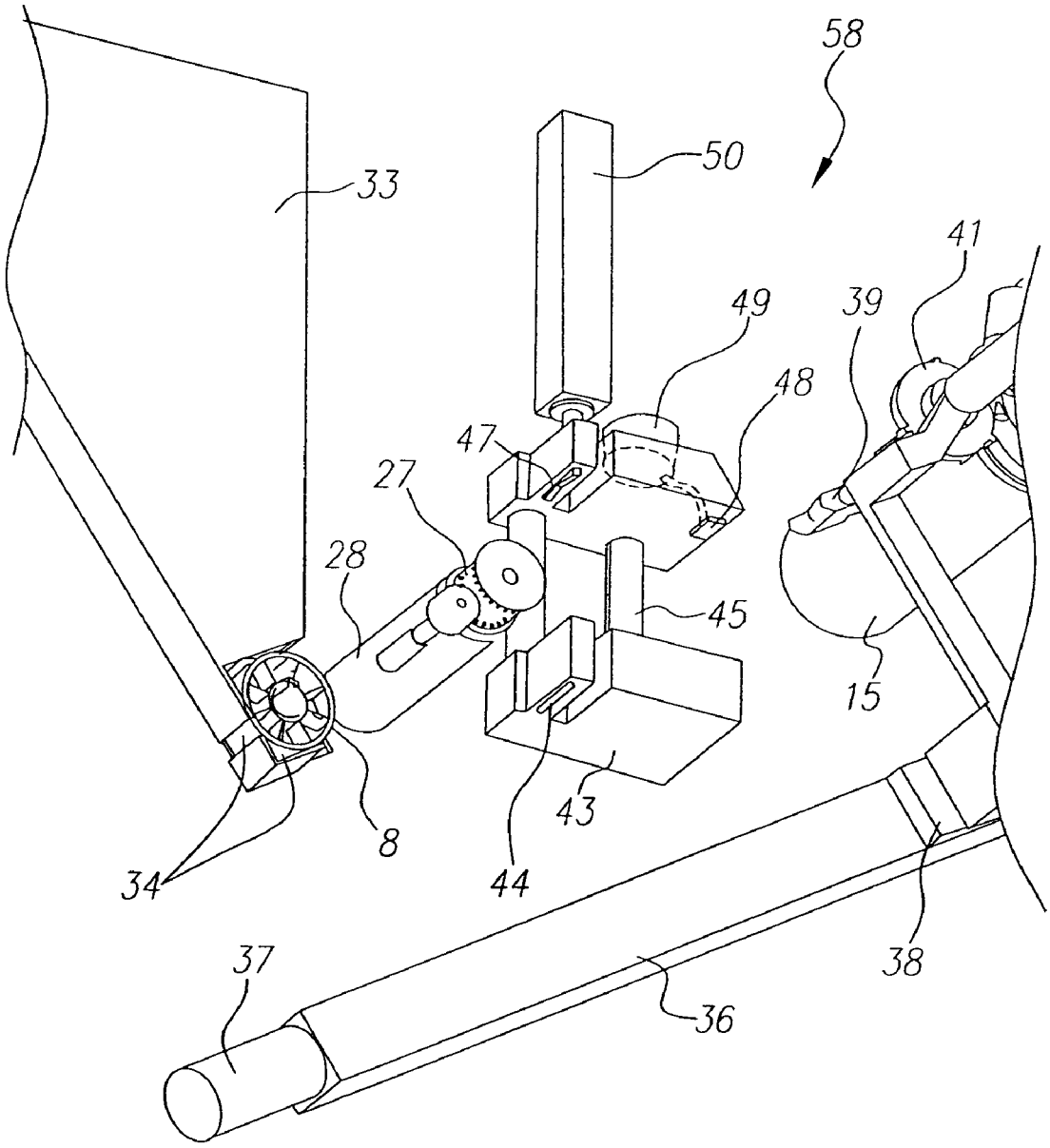
FIG. 2 is a perspective view from the bottom vantage point, of a portion of the overall automatic winding system as seen in FIG. 1.

The die assembly 32, also shown in FIG. 1 and FIG. 2, has a sprocket 27 and its associated sprocket drive 28, which is mounted to the machine frame 58 of automatic winding system 1. Adjacent to the sprocket 27 is a guide roller 29, which is also mounted to the machine frame 58 of automatic winding system 1. The guide roller 29 does not normally contact the perforated web 53; but prevents the perforated web 53 from coming off the sprocket 27 when the web tension is low.

A small gap between the sprocket 27 and the die base 43 which is also mounted to the machine frame 58 of automatic winding system 1, is provided to allow the web vacuum head 39 to transfer between the sprocket 27 and die base 43. The die slot 44 in the die base 43 is close to sprocket 27 to provide an accurate means of locating the web perforations 5 of the web leader and the registration of trailer edges (6,7) to these perforations.

The die base 43 supports die posts 45, which linearly guides the die top 46. The die top 46 is actuated up and down by die cylinder 50, which is connected to the die top 46 via a clevis 51, and connected to the rod end of the die cylinder 50. The other end of the die cylinder 50 is mounted to the machine frame 58 of the automatic winding system 1 by a means not shown. On the bottom surface (surface facing to the perforated web 53) of the die top 46 is the die punch 47 and adhesive applicator 48. Both the die punch 47 and adhesive applicator 48 contact the perforated web 53 during the closing of the die top 46. During the closing of the die assembly 32 a web punch slug 13 (and shown in FIG. 4) is created, which transfers into the die slot 44 of the die base 43. The top surface of the die top 46 has an adhesive reservoir 49, which is connected to the adhesive applicator 48 via tubing, and supplies an adhesive in a controlled fashion to the adhesive applicator 48.

The die punch 47 and adhesive applicator 48 is a very simple device for creating the leader adhesive feature 12. Other techniques for applying a variation of the leader adhesive feature 12, such as applying stickers (labels) or tapes are also possible, but can add some complexity to the automatic winding system.

Core Hopper

The core hopper 33 includes a gravity feed chamber 35, which is mounted to the machine frame 58 of automatic winding system 1. The bottom core 8 rests on datum surfaces to position the core 8 to be picked. An exit opening 34 at the bottom of the core hopper 33 provides full exposure of the core 8 from the front of the core hopper 33. There is also an opening at the core hopper 33 side, which allows the core 8 to be pulled out of the core hopper 33 parallel to the travel of the core loader assembly 31 device. The exit opening 34 also clears the core loader fingers 42, which constrain the outside diameter of the core 8, when the core loader support 41 engages the core 8.

The Splice Configuration

Figure 22A:
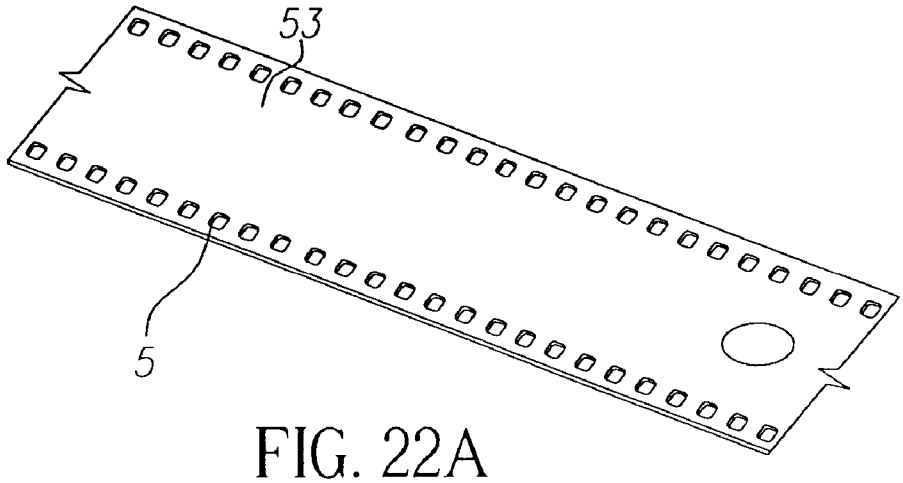
FIG. 22A is a perspective view of a perforated web prior to cutting and prior to adding the leader adhesive feature.

FIG. 22A illustrates perforated web 53 with evenly pitched perforations 5 that run the length of the web and are adjacent to each edge of the web. The perforations 5 are used in subsequent operations to convey the perforated web 53 with sprocket type devices, such as in a motion picture camera or projector.

Figure 22B:
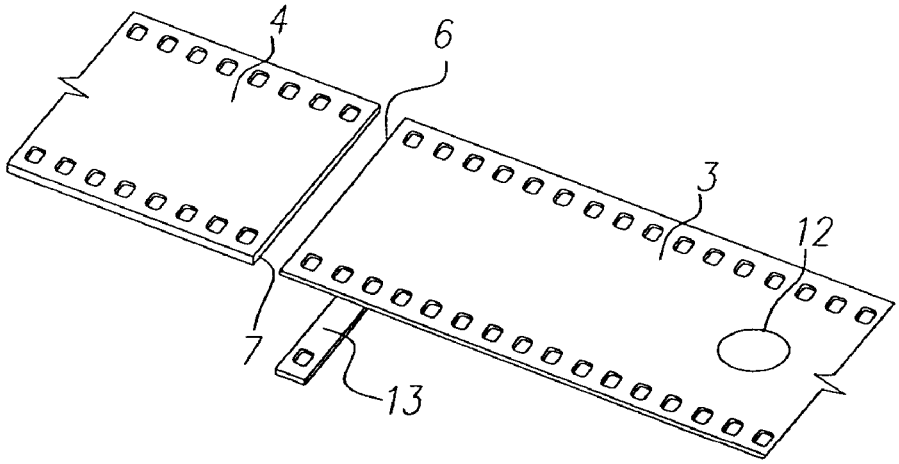
FIG. 22B is a perspective view of the perforated web with the web punch slug and leader adhesive feature applied to the web leader.
Figure 22C:
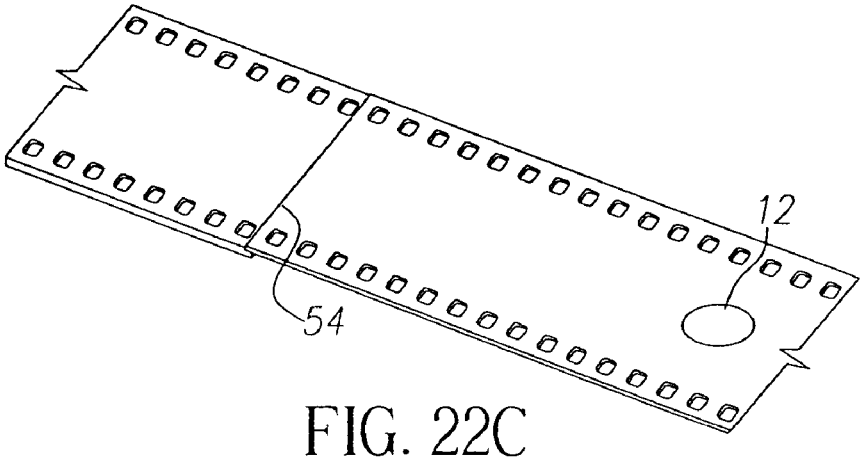
FIG. 22C is a perspective view of the subsequent ultrasonic lap splice for which the stock roll web leader and web trailer ends are configured.

FIG. 22B illustrates the features that the automatic winding system 1 creates when the die cylinder 50 and die top 46 are actuated. Both the leader adhesive feature 12 and the web punched slug 13 are generated by the operation of the die assembly 32. FIG. 4 illustrates specific dimensions and location of one example of a web punch slug 13 for 35 mm motion picture film (a perforated web). Variations of the dimensions illustrated can be made to achieve the desired overlap length of lap joint 54.

During subsequent operations in a down-stream process, the on-pitch lap splice illustrated in FIG. 22C is generated from web trailer 4 of one unwound web stock roll 2 to the web leader 3 of another web stock roll 2. No additional removal of web is required to form the desired lap joint.

Figure 23A:
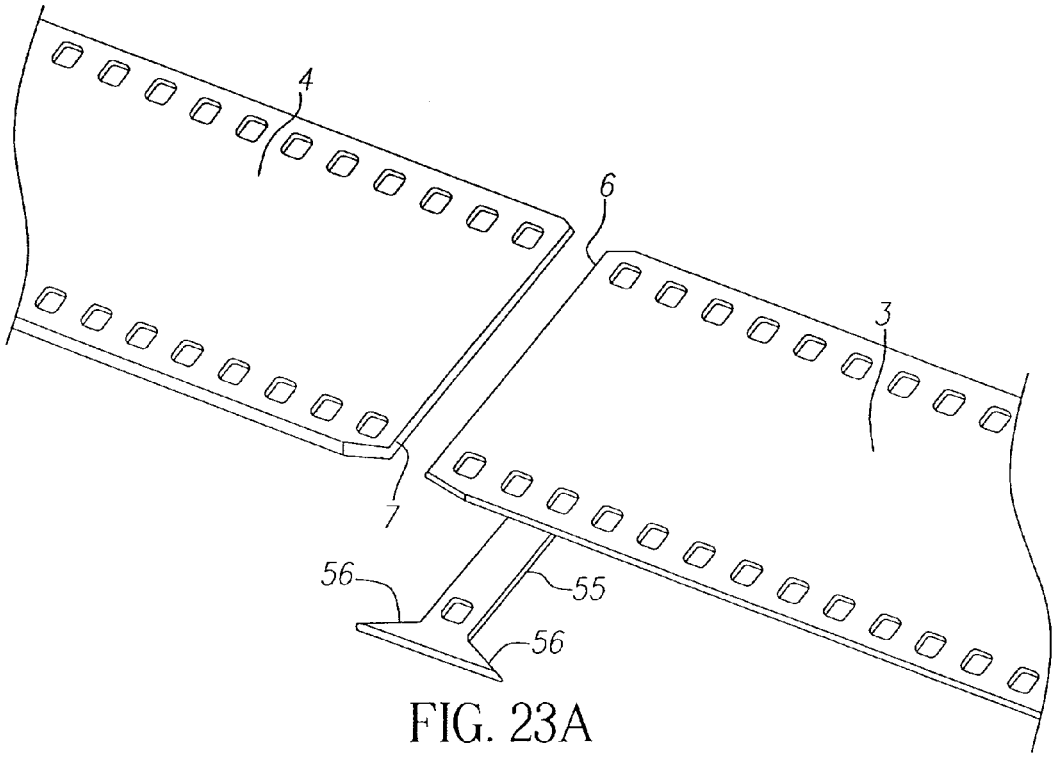
FIG. 23A is a perspective view of the perforated web similar to FIG. 22B, with a variation of added chamfers to the web leader and web trailer ends, and a variation in the shape of the web punch slug.
Figure 23B:
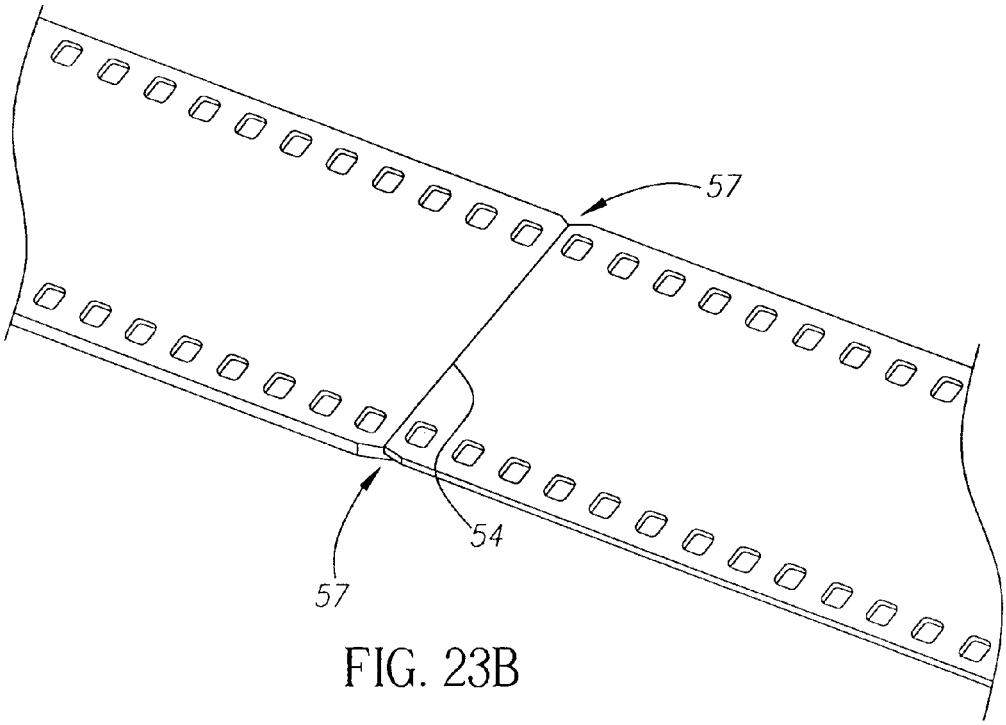
FIG. 23B is a perspective view of the subsequent ultrasonic lap splice for the web leader and web trailer shown in FIG. 23A.

The alternative shape of web punch slug 55 can be see in FIG. 23A and includes an added tab 56. The resulting lap joint 54, as seen in FIG. 23B, provides notches 57 at each end of the webs to be spliced to allow for the ultrasonic weld to flow into, and not extend beyond the width of, the perforated web 53. These notches 57 are desirable for down stream processes, which require the ultrasonic splice weld not to extend beyond the web outer edges. Other variations in the contour (such as curved or radius shapes) of the web leader edge 6 and web trailer edge 7, or notches 57 may be desired to achieve other benefits.

Process Steps

A series of exemplary operation steps for automatically generating web stock rolls 2 are as follows (Referring to FIGS. 6-21):

1 During a web winding process first web stock roll 2, the core loader cylinder 40 extends fully out at the core hopper 33 position to acquire a core 8 at the bottom of the core hopper 33.

2 The core loader support 41 is activated via vacuum pressure to grab core 8.

3 The core loader actuator 36 moves the core 8 just adjacent to the right of the core hopper 33 to cause the core 8 to escape from hopper 33. During this motion, the next available core 8 in the hopper 33 falls towards the hopper exit opening 34.

4 The core loader cylinder 40 fully retracts.

5 The core loader actuator 36 moves adjacent to the die assembly 32 in preparation to acquire the web trailer 3.

6 At the end of the web winding process, sprocket 27 stops the perforated web 53 to register the position of web perforations 5 in relation to die slot 44.

7 Vacuum pressure is activated on web vacuum head 39.

8 When the web winding process stops and the perforated web has stopped moving, the die cylinder 50 is activated down, to cut the web and to apply the leader adhesive feature 12 to the web leader 3 of the first web stock roll 2.

9 The die cylinder 50 is retracted; at the same time the web vacuum head 39 acquires the web leader 3. Note: the guide roller 29 prevents the perforated web 53 from moving off of sprocket 27.

10 The winding drive 15 rotates the web stock roll 2 to wrap the loose web leader 3 and leader adhesive feature 12 past the builder roller 26 to tack the web down to itself.

11 The builder roller 26 retracts away from the completed wound web stock roll 2.

12 After the winding spindle 14 releases core 8, an automated finished web stock roll unload device, not shown, removes the finished web stock roll 2. Note: An alternative method of operation would be the manual removal of the finished web stock roll 2 at this operation step.

13 The core loader assembly 31 moves to the winding spindle 14 position and, at the same time, the perforated web 53 is metered out by sprocket 27 and its associated sprocket drive 28 to match the required feed length.

14 The core loader cylinder 40 extends to place the empty core 8 over the winding spindle 14.

15 The winding spindle 14 is then activated to engage the empty core 8.

16 The vacuum pressure to the core loader support 41 is de-energized, and the core loader cylinder 40 retracts.

17 Initially, the cinching roller 18 is at the 6 o'clock position, and the cinching roller arm actuator 19 rotates the cinching roller 18 against web trailer 4, which extends just beyond the web vacuum head 39. Now, the web trailer 4 is pinched between the cinching roller 18 and core 8.

18 The core loader assembly 31 returns to the core 8 pick position at the core hopper 33.

19 The winding drive 15 turns CCW, keeping the web tensioned, as the sprocket 27 and its associated sprocket drive 28 meters out a length of perforated web 53 less than the circumference of core's 8 outer diameter.

20 The cinching actuator 22 drives the cinching roller 18 CCW, wrapping the web trailer 4 about core 8, to a position that just clears nip formed by the entering perforated web 53 and core 8. The cinching roller 18 continues to pinch the web trailer 4 to the core 8.

21 The builder roller actuator 24 lowers the builder roller 26 in contact to the web trailer 4, which is partially wrapped on the supporting core 8, to provide an additional cinching force.

22 The sprocket 27 and its associated sprocket drive 28 now meters out several convolutions of perforated web 53, and the winding drive 15 rotates in a torque mode to generate several wraps of perforated web 53 onto the core 8.

23 The sprocket 27 and its associated sprocket drive 28 stops feeding the perforated web 53 to the winding assembly 52, and the web trailer 4 cinches to the core 8, until the winding drive 15, which is in torque mode, stalls. Now the web trailer 4 has completed cinching to the core 8.

24 The builder roller 26 is actuated off the cinched web trailer 4 and core 8 to provide clearance for the cinching roller 18 to return to its initial home position.

25 The cinching roller 18 rotates back CW to its home 6 o'clock position. The cinching actuator 22 also swings the cinching roller 18 back behind the cinched web trailer 4 via the cinching roller arm actuator 19.

26 The builder roller 26 is actuated again to contact the web trailer 4 cinched on the core 8 at the wind position.

27 The web stock roll 2 winding process begins again.

In FIGS. 24A-24D exemplary process flow diagrams are shown of an automatic winding system 1, which implements the present invention.

Figure 24A:
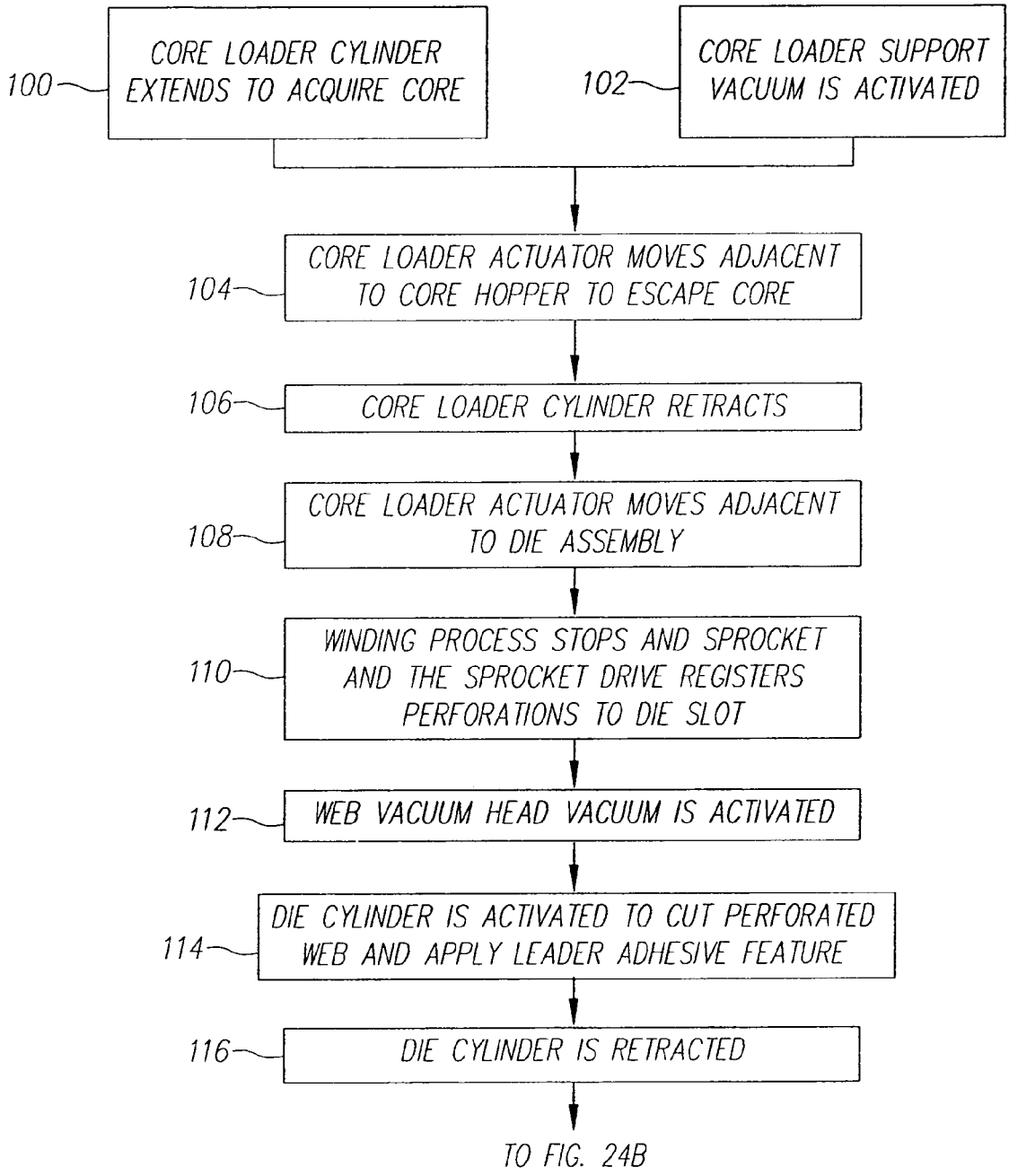
FIG. 24A is the beginning of an exemplary process flow diagram of an automatic winding system, which implements the present invention.

As seen in FIG. 24A, and in operation 100, the core loader cylinder 40 extends to acquire the core 8, which is at the exit opening 34 of the core hopper 33. The core loader support 41 vacuum pressure is also activated to hold the core 8, as seen in operation 102.

In operation 104 the core loader actuator 36 moves its associated tooling adjacent to the core hopper 33, to escape the core 8, which is held by the core loader support 41. The fingers 42, which extend from the core loader support 41, also surround and capture the core 8.

In operation 106 the core loader cylinder 40 retracts, so the core 8 is held away from the web vacuum head 39, to provide clearance in subsequent operations.

The core loader actuator 36 moves the web vacuum head 39 adjacent, and between the sprocket 27 and the die base 43, as seen in operation 108.

In operation 110 the winding process stops, and the sprocket 27 and associate sprocket drive 28 registers perforations 5, of the perforated web 53, to the die slot 44, in preparation for cutting the web leader and web trailer edges (6,7).

The web vacuum head 39 vacuum pressure is activated in operation 112, in preparation for acquiring the web trailer 4 end of the web, which will be formed.

In operation 114 the die cylinder 50 is activated to cut the perforated web 53, and to apply the leader adhesive feature 12 to a portion of the web leader 3. The perforated web 53 is cut by the die punch 47 and its associated die slot 44 to create the web leader edge 6, web trailer edge 7, and web punch slug 13. Also, the adhesive applicator 48, which dispenses an adhesive, contacts the perforated web 53 to apply the leader adhesive feature 12 at a specific distance from its associated web leader edge 6.

The die cylinder 50 is retracted, as seen in operation 116. A portion of the newly created web trailer 4 is pulled flat onto the web vacuum head 39 by its vacuum pressure.

Figure 24B:
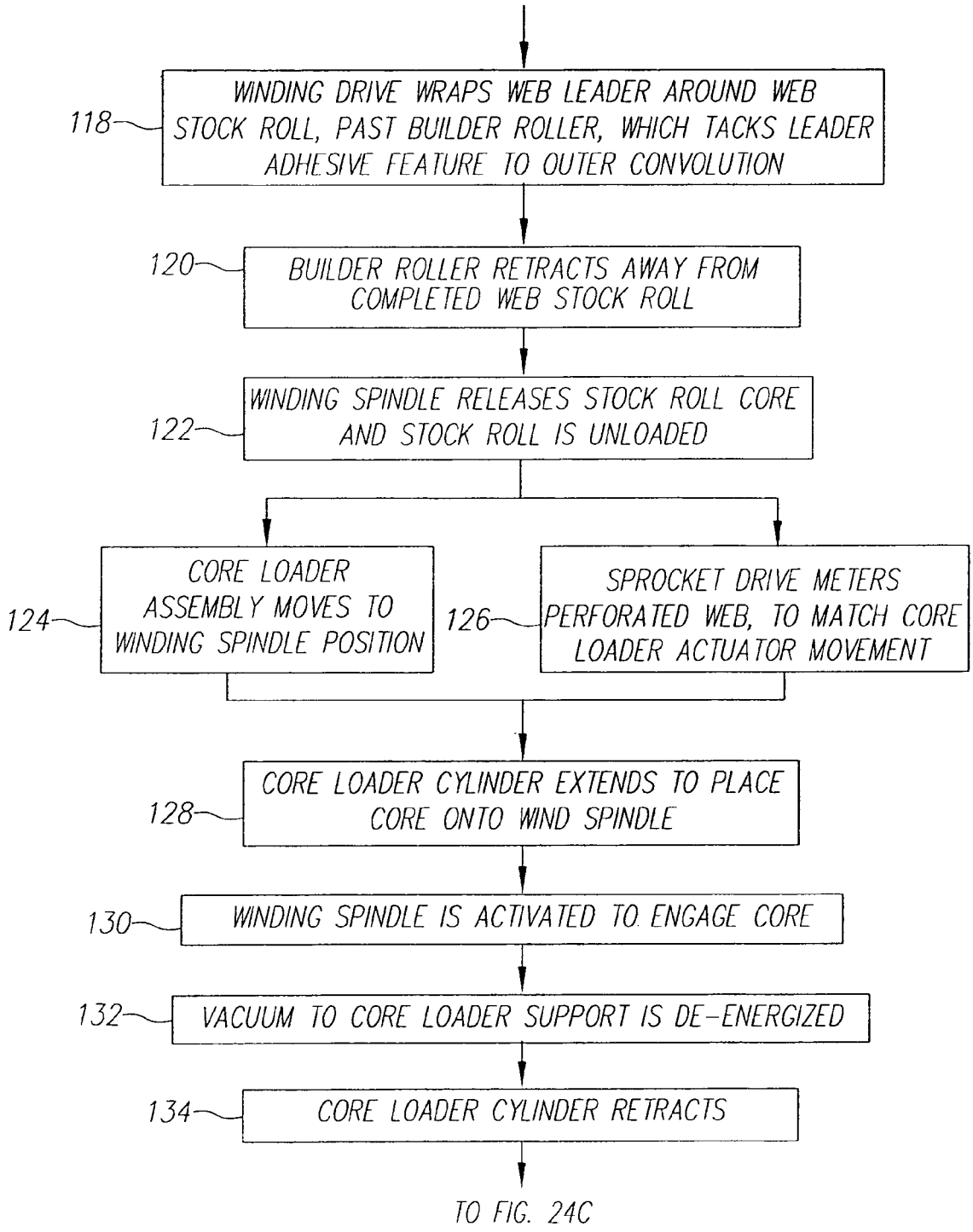
FIG. 24B is a continuation of the exemplary process flow diagram seen in FIG. 24A, of an automatic winding system, which implements the present invention.

Continuing in FIG. 24B, and in operation 118, winding drive 15 rotates to completely wrap the web leader 3 around its web stock roll 2. During the wrapping of the web leader 3, the leader adhesive feature 12 is pressed against the outer convolution of perforated web 53 by the builder roller 26, thereby tacking the leader adhesive feature 12 to the outer convolution of perforated web 53.

In operation 120 the builder roller 26 is retracted away from the wound web stock roll 2 in preparation for web stock roll 2 unloading.

In operation 122 the winding spindle 14 releases the web stock roll core 8 and the web stock roll 2 is unloaded off the winding spindle 14.

The core loader actuator 36 moves its associated tooling to the winding spindle 14 position, as seen in operation 124. Also, in operation 126 the sprocket drive 28 and its associated sprocket 27 meters the perforated web 53 to match the core loader actuator 36 movement.

In operation 128 the core loader cylinder 40 extends to place the core 8 onto the wind spindle 14.

In operation 130 the winding spindle 14 is activated to engage the core 8.

Vacuum to the core loader support 41 is de-energized, as seen in operation 132.

In operation 134 the core loader cylinder 40 retracts leaving the core 8 supported by the winding spindle 14.

Figure 24C:
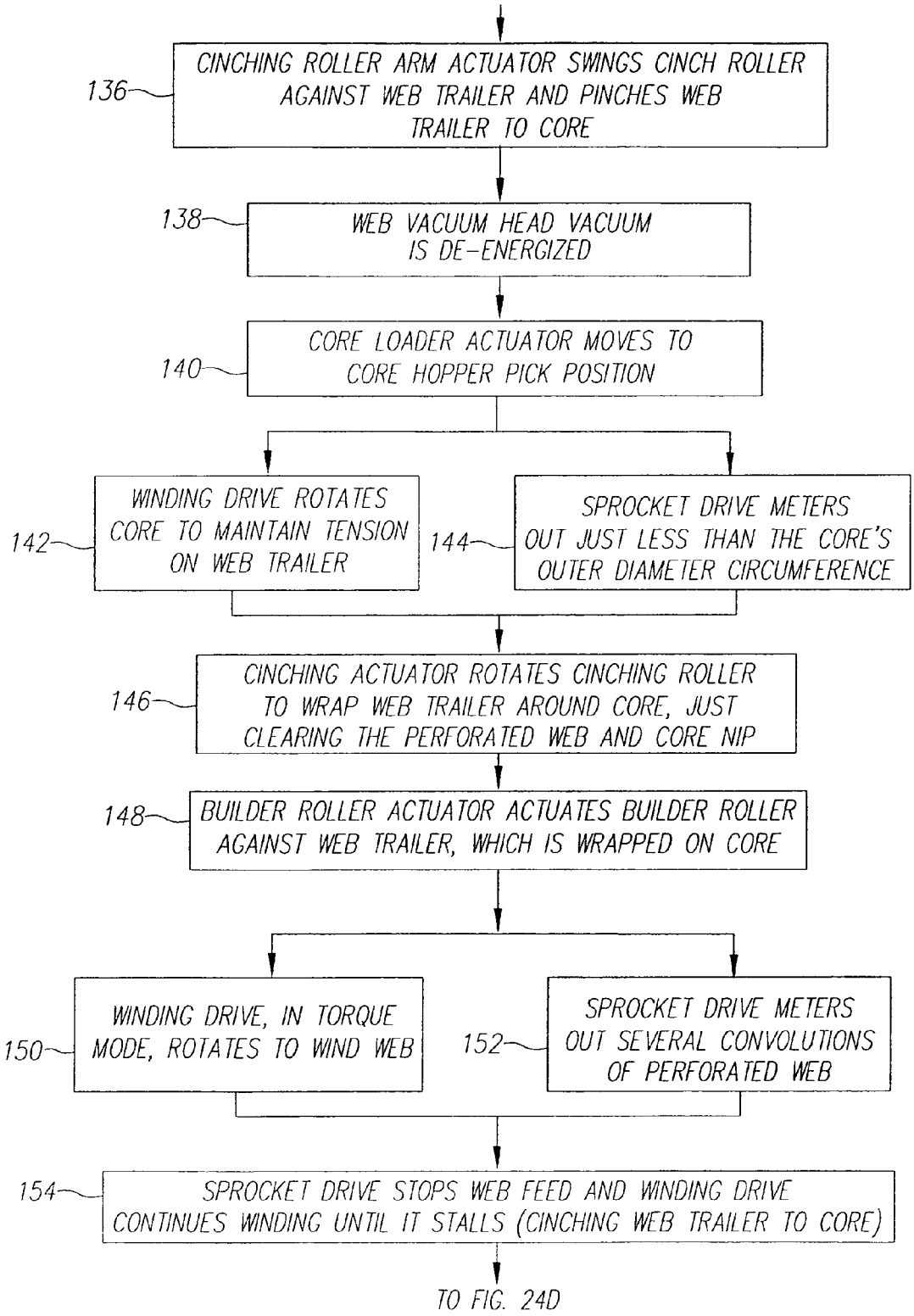
FIG. 24C is a continuation of the exemplary process flow diagram seen in FIG. 24B, of an automatic winding system, which implements the present invention.

Referring to FIG. 24C, a short portion of the web trailer 4 extends beyond the web vacuum head 39, and this portion of the web trailer 4 is also now adjacent to the core 8, which is on the winding spindle 14. In operation 136 the cinching roller arm actuator 19 swings the cinch roller 18 against the web trailer 4, which in turn pinches the end of the web trailer 4 against the adjacent core 8.

In operation 138 the vacuum to the web vacuum head 39 is de-energized, releasing hold of the web trailer 4.

The core loader actuator 36 moves its associated tooling to the initial core hopper 33 pick position, as seen in operation 140.

In operation 142 the winding drive 15 rotates the core 8 and in turn tensions the perforated web 53 span between the core 8 and sprocket 27, due to the pinching force of the cinching roller 18 against the web trailer 4. Also, the sprocket drive 28 and its associated sprocket 27 meter out just less than the core's 8 outer diameter circumference of web length, as seen in operation 144.

Now the web trailer 4, which extends freely beyond the nip formed by the core 8 and the cinching roller 18, is of sufficient length to wrap nearly around the outer diameter circumference of the core 8. In operation 146 the cinching actuator 22 rotates the cinching roller 18, in a planetary fashion, around the core 8, thus wrapping the web trailer 4 around most of the core 8. At the end of this motion, the web trailer 4 is still pinched between the core 8 and the cinching roller 18. And now the web trailer 4 and the cinching roller 18 is adjacent to the initial nip formed by the core 8 and the web trailer 4.

In operation 148 the builder roller actuator 24 actuates the builder roller 18 against the wrapped web trailer 4 and the core 8, providing additional force between the web trailer 4 and the core 8.

In operation 150 the winding drive 15, which is in a predetermined torque mode, rotates to wind the perforated web 53 onto the core 8. Also, in operation 152, the sprocket drive 28 and its associated sprocket 27 meter out several convolutions of perforated web 53 to wrap onto the core 8.

In operation 154 the sprocket drive 28 and its associated sprocket 27 stop the perforated web 53 feed, and the winding drive 15 continues to wind the perforated web 53 until it stalls, which cinches the web trailer 4 tightly to the core 8.

Figure 24D:
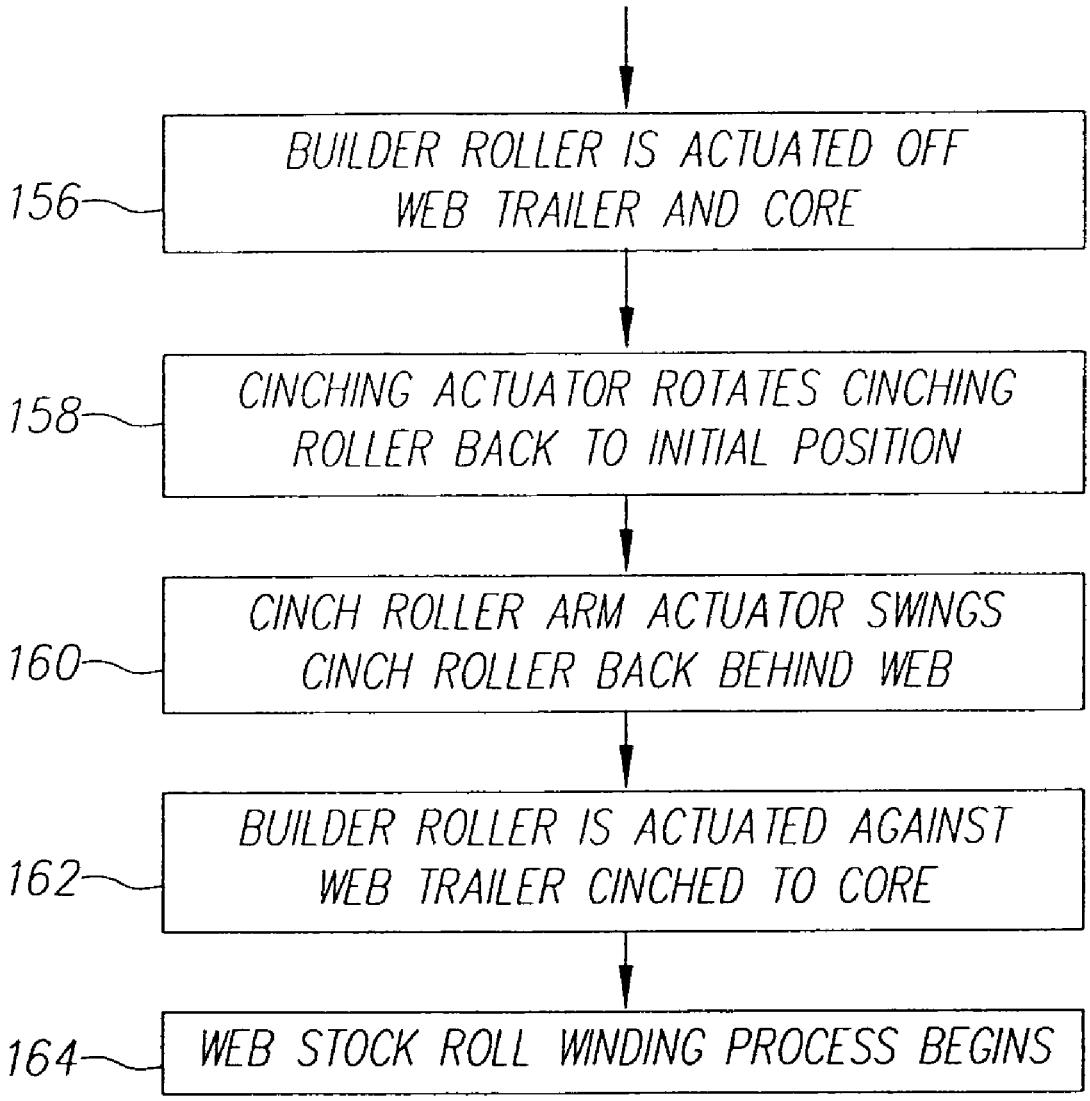
FIG. 24D is a continuation of the exemplary process flow diagram seen in FIG. 24C, of an automatic winding system, which implements the present invention.

Continuing in FIG. 24D, and in operation 156, the builder roller actuator 24 actuates the builder roller 18 off the wrapped web trailer 4 and the core 8, providing clearance for the pending motion of the cinching roller 18 and its associated cinching roller arm 17.

In operation 158 the cinching actuator 22 rotates the cinching roller 18, in a planetary fashion, back to its initial home position.

In operation 160 the cinch roller arm actuator 19 swings the cinch roller 18 and cinching roller arm 17 back behind the perforated web path to their initial position.

The builder roller actuator 24 actuates the builder roller 18 against the wrapped web trailer 4 and the core 8, in preparation for winding, as seen in operation 162.

In operation 164 the web stock roll 2 winding process begins. The sprocket drive 28 and its associated sprocket 27 meter out web at a controlled rate as the winding drive 15 winds the perforated web 53 at a controlled torque. Also, the builder roller 26, actuated by the builder roller actuator 24, remains in contact, under a controlled force, with the outside diameter of the building web stock roll 2.

The present invention has been described above with reference to one or more preferred embodiments. However, one can appreciate that a person of ordinary skill in the art can effect variations and modifications to the disclosed present invention without departing from the scope of the present invention.

PARTS LIST

1 automatic winding system
2 web stock roll
3 web leader
4 web trailer
5 web perforations
6 web leader edge
7 web trailer edge
8 core
9 web side facing in
10 web side facing out
11 roll of web
12 leader adhesive feature
13 web punched slug
14 winding spindle
15 winding drive
16 cinching roller support
17 cinching roller arm
18 cinching roller
19 cinching roller arm actuator
20 belt
21 drive pulley
22 rotary actuator
23 driven pulley
24 builder roller actuator
25 builder roller support
26 builder roller
27 sprocket
28 sprocket drive
29 guide roller
30 builder roller assembly
31 core loader assembly
32 die assembly
33 core hopper
34 exit opening
35 gravity feed chamber
36 core loader actuator
37 core loader drive
38 support arm
39 web vacuum head
40 core loader cylinder
41 core loader support
42 fingers
43 die base
44 die slot
45 die posts
46 die top
47 die punch
48 adhesive applicator
49 adhesive reservoir
50 die cylinder
51 cylinder clevis
52 winding assembly
53 perforated web
54 lap joint
55 alternate web punch slug
56 tab feature
57 notches
58 machine frame
100 operation
102 operation
104 operation
106 operation
108 operation
110 operation
112 operation
114 operation
116 operation
118 operation
120 operation
122 operation
124 operation
126 operation
128 operation
130 operation
132 operation
134 operation
136 operation
138 operation
140 operation
142 operation
144 operation
146 operation
148 operation
150 operation
152 operation
154 operation
156 operation
158 operation
160 operation
162 operation
164 operation

What is claimed is:

1. An automatic web winding system for creating a registered perforated web stock roll, from a perforated web, that includes a web leader and a web trailer, comprising:

a) a die assembly that creates the web leader of a first perforated web stock roll and the web trailer of a second perforated web stock roll;

b) a winding assembly that automatically wraps and cinches the web trailer to an associated removable core of the second perforated web stock roll prior to forming the second perforated web stock roll; and c) a core loader assembly that automatically loads the removable core onto the winding assembly and transfers the web trailer to winding assembly.

2. The automatic web winding system claimed in claim 1, wherein the die assembly further includes:

a1) a sprocket for positioning perforations in the first and second web stock rolls prior and during a cutting operation of the die assembly;

a2) a sprocket drive for driving the sprocket into a predetermined registered position and advancing the perforated web during winding.

3. The automatic web winding system claimed in claim 1, further comprising:

d) a builder roller assembly that enables the first and second web stock rolls to form with flat sidewalls and tightly wound convolutions.

4. The automatic web winding system claimed in claim 1, further comprising a leader adhesive feature for tacking the outer convolution of the first and second web stock roll to themselves.

5. The automatic web winding system claimed in claim 4, wherein a builder roller assembly presses the leader adhesive feature to the web stock rolls.

6. The automatic web winding system claimed in claim 4, wherein the adhesive feature is supplied from an adhesive reservoir via tubing connected to an adhesive applicator.

7. The automatic web winding system claimed in claim 1, wherein the die assembly performs straight cuts upon the perforated web.

8. The automatic web winding system claimed in claim 1, wherein the die assembly performs contoured cuts upon the perforated web.

9. The automatic web winding system claimed in claim 7 and 8, wherein two separate cuts are performed upon the perforated web.

10. The automatic web winding system claimed in claim 1, wherein the perforated web is photographic film.

11. A method for creating registered perforated web stock rolls from a perforated web, comprising the steps of:

a) registering the perforated web within a die assembly;

b) forming a web leader of a first perforated web stock roll and a web trailer of a second perforated web stock roll by actuating the die assembly upon the perforated web;

c) winding of the web leader of the first perforated web stock roll upon itself to form a final convolution;

d) transferring the web trailer of the second perforated web stock roll to a winding assembly;

e) cinching the web trailer of the second perforated web stock roll to its associated removable core; and f) winding the web trailer, and additional perforated web of the second perforated web stock roll around the removable core to form the second perforated web stock roll.

12. The method claimed in claim 11, further comprising the step of:

g) tacking a leader adhesive feature onto an outer convolution of the first and second web stock rolls.

13. The method claimed in claim 12, wherein the adhesive feature is supplied from an adhesive reservoir via tubing connected to an adhesive applicator.

14. The method claimed in claim 11, wherein the die assembly performs straight or contoured cuts upon the perforated web.

15. The method claimed in claim 14, wherein two separate cuts are performed upon the perforated web.

16. The method claimed in claim 11, wherein the perforated web is photographic film.

* * * * *